US010746491B2

(12) United States Patent
Garst et al.

(10) Patent No.: US 10,746,491 B2
(45) Date of Patent: Aug. 18, 2020

(54) FIREARM SUPPRESSION DEVICE

(71) Applicant: Ascendance International, LLC, Highlands Ranch, CO (US)

(72) Inventors: Joseph Garst, Highlands Ranch, CO (US); Sean Nathaniel McCullum, Herndon, VA (US)

(73) Assignee: Ascendance International, LLC, Highlands Ranch, CO (US)

( * ) Notice: Subject to any disclaimer, the term of this patent is extended or adjusted under 35 U.S.C. 154(b) by 0 days.

(21) Appl. No.: 16/548,798

(22) Filed: Aug. 22, 2019

(65) Prior Publication Data

US 2020/0141679 A1 May 7, 2020

Related U.S. Application Data

(63) Continuation-in-part of application No. 16/106,750, filed on Aug. 21, 2018, now Pat. No. 10,429,146, which is a continuation of application No. 15/408,224, filed on Jan. 17, 2017, now Pat. No. 10,107,581.

(60) Provisional application No. 62/279,801, filed on Jan. 17, 2016.

(51) Int. Cl.
*F41A 21/30* (2006.01)

(52) U.S. Cl.
CPC ..... *F41A 21/30* (2013.01)

(58) Field of Classification Search
CPC ..... F41A 21/30; F41A 21/32; F41A 21/34; F41A 21/36; F41A 21/38
See application file for complete search history.

(56) References Cited

U.S. PATENT DOCUMENTS

| | | | | | |
|---|---|---|---|---|---|
| 1,427,802 | A * | 9/1922 | Goodwin | F41A 21/30 | 181/223 |
| 1,605,864 | A * | 11/1926 | Steinegger | F41A 21/30 | 89/14.3 |
| 2,442,773 | A | 6/1948 | Mason | | |
| 2,514,996 | A | 7/1950 | Faust | | |
| 2,796,005 | A * | 6/1957 | Shapel | F41A 21/36 | 89/14.3 |
| 2,916,970 | A * | 12/1959 | Mutter | F41A 21/00 | 89/14.3 |
| 4,291,610 | A | 9/1981 | Waiser | | |
| 4,576,083 | A | 3/1986 | Seberger, Jr. | | |
| 5,136,923 | A | 8/1992 | Walsh, Jr. | | |
| 6,308,609 | B1 | 10/2001 | Davies | | |
| 6,374,718 | B1 | 4/2002 | Rescigno et al. | | |

(Continued)

FOREIGN PATENT DOCUMENTS

| | | |
|---|---|---|
| DE | 2540419 A1 | 3/1977 |
| EP | 2191223 B1 | 11/2011 |

(Continued)

*Primary Examiner* — Gabriel J. Klein
(74) *Attorney, Agent, or Firm* — Voz Patents, LLC.

(57) ABSTRACT

The present invention pertains in general to a suppressing apparatus for the suppression of audible, visible and infrared profiles in the operation of firearms and weapon systems. Embodiments of the invention include the use of a substantially cylindrical component having a helical opening for the dispersion of gasses in conjunction with channels and volumes configured to carry the gasses along the length of the suppressing apparatus toward a distal aspect and toward a proximal aspect alternatively.

9 Claims, 22 Drawing Sheets

(56) References Cited

U.S. PATENT DOCUMENTS

| | | | | |
|---|---|---|---|---|
| 6,575,074 | B1 | 6/2003 | Gaddini | |
| 7,207,258 | B1 | 4/2007 | Scanlon | |
| 7,308,967 | B1 | 12/2007 | Hoel | |
| 7,832,323 | B1 | 11/2010 | Davies | |
| 8,162,100 | B2 | 4/2012 | Shults et al. | |
| 8,424,441 | B2 | 4/2013 | Brittingham et al. | |
| 8,511,425 | B2 | 8/2013 | Larue | |
| 8,561,757 | B1 | 10/2013 | Edsall | |
| 8,567,556 | B2 | 10/2013 | Dueck et al. | |
| 8,584,794 | B2 | 11/2013 | Dueck | |
| 8,857,306 | B1 | 10/2014 | Edsall | |
| 8,939,057 | B1 | 1/2015 | Edsall | |
| 8,973,481 | B2 | 3/2015 | Dueck et al. | |
| 9,038,770 | B1 | 5/2015 | Morrison | |
| 9,140,511 | B2 | 9/2015 | Michal et al. | |
| 9,599,421 | B1 * | 3/2017 | Dean | F41A 21/30 |
| 9,658,010 | B1 | 5/2017 | Oglesby | |
| 9,777,979 | B2 | 10/2017 | Washburn et al. | |
| 9,803,946 | B2 * | 10/2017 | Schoenlau | F41A 21/32 |
| 10,119,779 | B1 | 11/2018 | Miele et al. | |
| 2010/0180759 | A1 | 7/2010 | Petersen | |
| 2012/0145478 | A1 | 6/2012 | Brittingham | |
| 2012/0199415 | A1 | 8/2012 | Shults et al. | |
| 2016/0109205 | A1 | 4/2016 | Coppinger et al. | |
| 2016/0161203 | A1 * | 6/2016 | Wilson | F41A 21/30<br>89/14.3 |
| 2018/0038663 | A1 | 2/2018 | LaRue | |
| 2019/0257607 | A1 * | 8/2019 | Dobrinescu | F41A 21/30 |

FOREIGN PATENT DOCUMENTS

| | | | | |
|---|---|---|---|---|
| FR | 597737 A | | 11/1925 | |
| FR | 1487493 A | * | 7/1967 | F41A 21/36 |

* cited by examiner

FIREARM SUPPRESSION DEVICE

CROSS REFERENCE TO RELATED APPLICATIONS

This application claims benefit to and is a continuation-in-part of nonprovisional patent application Ser. No. 16/106,750, Filed Aug. 21, 2018—currently pending, which is a continuation of nonprovisional patent application Ser. No. 15/408,224, entitled "Firearm Suppression Device", filed on Jan. 17, 2017—now U.S. Pat. No. 10,107,581—which claims benefit of provisional patent application No. 62/279,801, entitled "Firearm Suppression Device", filed Jan. 17, 2016—which all are incorporated by reference in their entirety for all purposes.

FIELD OF THE INVENTION

The present invention pertains in general to the suppression of firearm and weapon systems to mitigate audible, visual and temperature profiles when in use.

BACKGROUND OF INVENTION

Firearms, typically understood as a barreled weapon designed to launch a projectile toward an intended target have developed over centuries. Many developments have been made over the ages, but firearms have typically utilized the use of an explosive charge to create a rapidly expanding, controlled and directed volume of gas to propel a projectile out of the end of a barrel at high velocities.

A large factor in the creation of sound when discharging a firearm, often referred to as a report, is due to the escape and rapid and uncontrolled expansion of the explosive charge out of the muzzle-end wherein the projectile exits the firearm. This sound surrounding the escape of the rapidly expanding gas out of the muzzle-end of a firearm is often referred to as muzzle-blast.

Due to the explosive nature of the charge driving the projectile, the muzzle-blast is also often accompanied with muzzle-flash. Muzzle-flash is the visible light that exits the firearm from the muzzle-end associated with an explosive charge originating from within the firearm.

In many situations it is desirable to mask, muffle, suppress or otherwise mitigate the muzzle-blast and muzzle-flash of a firearm during use. The mitigation or suppression of these factors of a firearm may provide the operator with an increased tactical advantage and when operating in a covert manner. Some of the advantages associated with this increased tactical advantage over an intended target or enemy due to the suppression of the muzzle-blast include—increased difficulty in identifying the location of the firearm, masking the direction from which the firearm is firing, the reduction of noise levels to safe hearing levels, and the altering of a characteristic noise signature, which may indicate the distance, type or specific model of weapon.

A common solution to mitigate or suppress the muzzle-blast and/or muzzle-flash of a weapon surrounds the use of a suppressor, sometimes referred to as a "silencer" or "can," affixed to the muzzle-end of a weapon to provide an intermediate expansion volume for rapidly expanding gasses related to the firing of the weapon. This intermediate expansion volume allows the control of the muzzle-blast and muzzle-flash within an enclosed space prior to exiting the suppressor. This intermediate expansion volume also allows controlled expansion of gasses related to the explosive charge exiting the muzzle of the weapon. By the time the rapidly expanding gas from the explosive charge reaches the ambient environment, after passing through the intermediate expansion volume, the differential pressure between the explosive charge related gasses and the ambient air is decreased. A decreased differential pressure, results in a lesser audible signature when such gasses related to the explosive charge rapidly expand in the ambient air. The visual signature related to muzzle-blast and muzzle-flash is also decreased to a lesser level due to the intermediate expansion volume. This intermediate expansion volume is intended to suppress the audible and visual signatures, herein collectively referred to as "firearm signature," to levels offering increased tactical advantages.

The suppression of firearm signatures typically involves a device attached to the muzzle-end of a firearm to provide intermediate expansion volume and suppression of firearm signature with minimal or no impedance upon the trajectory or flight path of the projectile exiting the muzzle of the firearm.

A common problem with the use of suppressors in the field of firearm suppressors surround heat retained by the suppressor as well as an undesired phenomenon known as blowback. Blowback may occur with the use of a suppressor, through which rapidly expanding gasses enter a restricted volume of the suppressor and cannot escape entirely through an aperture provided for the flight path of a projectile or other venting apertures. As a result, a portion of the rapidly expanding gasses travel back down the barrel of the firearm back toward the operator of the firearm. Dependent upon the style of weapon, blowback gasses may exit the weapon through parts of a weapon including an ejection port, trigger assembly, bolt, receiver or charging handle area such as with a firearm disclosed U.S. Pat. No. 5,351,598 to Schuetz, herein incorporated in its entirety by reference. The effects of blowback include an increased rate of carbon deposits within the working mechanisms of the firearm, increased operating pressure within a weapon, increased wear and tear of a weapon, and a decrease in reliability of a weapon. Furthermore, blowback sometimes results in gasses exiting the weapon through previously discussed parts of the weapon after travelling back from the muzzle-end of the firearm and toward the operator. This blowback sometimes exits the weapon toward an operator's face and adversely affects the operators vision or respiratory function, endangering the operator.

Another common problem surrounding the use of existing suppressor devices include factors that negatively affect an operator's interaction with the weapon. The attachment of a metallic suppressor device increases the weight of a weapon in an asymmetric manner that affects the operator's ability to use the weapon in a manner consistent with normal use. A weapon with increased weight affixed to the muzzle-end, or firing-end, of the weapon is no longer balanced as it would be in normal operation without the affixed suppressor. This can cause inconsistent firing accuracy as well as accelerated fatigue of the weapon operator.

Yet another problem associated with the use of existing suppressor devices is the increased operating temperatures of the exposed housing of the suppressor and other heat conductive parts of a firearm such as metal rails. In some scenarios, the operating temperature of a suppressor may exceed temperatures of 426° C. (800° F.). A rail, or Picatinny rail, and other parts of a firearm may be appreciated to include, for example, those described by U.S. Pat. No. 9,032,860 to Faxon (Faxon) and U.S. Pat. No. 3,236,155 to Sturtevant (Sturtevant), each herein incorporated by reference in their entirety. Contact with a heated surface, such as the exposed housing of a suppressor by the operator or others in near proximity of the firearm may result in injury and distraction to the operator. Distractions in certain environments, such as covert operations or dynamic situations may result in life-threatening consequences to an operator or those surrounding them. As operators in military scenarios often work in teams, these life-threatening consequences may also affect a team, within which the weapon operator works.

A problem with certain existing suppressor devices is in relation to the weight of the unit. Having the suppressor mounted at the muzzle-end of a weapon results in large moment forces on the weapon held by the operator. It will be appreciated that added weight is generally undesirable, and further it will be appreciated that unbalanced added weight on a weapon which is otherwise designed for balance will result in accelerated fatigue and potential inaccurate operation of a weapon. Thus, a device providing the benefits of modern suppressors at a reduced weight is desired to limit the accelerated fatigue of a weapon operator.

A problem with certain existing suppressor devices surrounds the complexity of assembly of parts and maintenance after use due to fouling. If disassembled for purposes of maintenance in the field, a possibility exists that the device will be reassembled improperly which may result in malfunction of the device, damage to the device, or in a worst-case scenario, cause a catastrophic failure which may cause injury or death to an operator.

SUMMARY OF INVENTION

The present invention surrounds a suppressor for the mitigation of firearm signature while addressing problems associated with other existing devices in the field of firearm suppression.

Some existing suppressors attempt to mitigate firearm signature and do so with a sealed metallic enclosure with internal baffling such as employed by U.S. Pat. No. 8,973,481 to Dueck, et al. (Dueck), herein incorporated by reference in its entirety. Dueck provides firearm signature mitigation with an intermediate expansion volume comprising a substantially sealed volume with openings at the distal ends for the passage of a projectile and associated expanding gasses. Where Dueck fails to address certain problems associated with the suppression of firearms is the issue surrounding blowback and excessive temperature retained by the suppressor.

Some suppressors attempt to provide increased suppression through the use of vent holes in the outer surface of the suppressor as used by U.S. Pat. No. 8,322,266 to Presz, et al. (Presz), herein incorporated by reference in its entirety. The vent holes in the outer surface of the suppressor described by Presz provide further mitigation of such issues of blowback and muzzle-flash suppression, however the design as disclosed by Presz in operation of a firearm, retains heat in excess of temperatures safe to the touch.

Some existing suppressor devices attempt to mitigate the high temperature issue as related to the operation of a firearm in conjunction with a suppressor device attached to the muzzle-end as used by U.S. Pat. No. 9,140,511 to Michal, et al. (Michal), herein incorporated by reference in its entirety. Michal describes a sleeve designed to interface with the outer surface of a suppressor with interior splines, and exterior splines disposed at an angle to the interior splines. The configuration of Michal provides insulation to limit heat conduction and limiting the exterior touch temperature of the sleeve when used with a suppressor. Michal fails to address problems associated with blowback. Furthermore, Michal's insulation strategy prevents the cooling of the suppressor. This leaves the firearm subjected to negative operational effects of excessive heat retained by the firearm and suppressor device.

Existing suppressors allow for a limited number of rounds to be fired prior to the external surface of the suppressor rising above safe-to-touch temperatures. The Standard Guide for Heated System Surface Conditions that Produce Contact Burn Injuries—ASTM International (2014). ASTM C1055-03: Standard Guide for Heated System Surface Conditions that Produce Contact Burn Injuries—specifies that a person can touch a surface exhibiting a temperature below 60° C. (140° F.) for up to 5 seconds without sustaining irreversible injury from burn damage. Existing suppressors exhibit temperatures in excess of 60° C. (140° F.) after only a few rounds have been fired. It is an aspect of the present invention to provide a suppressor which can accommodate the firing of repeated rounds in rapid succession while an external aspect of the suppressor remains below the 60° C. (140° F.) threshold. Thus, the suppressor of certain embodiments does not pose a burn risk to operators and members of their team when in close quarters.

It will be appreciated that for the purposes of the present invention, a proximal designation surrounds a portion of an element being closer to an operator when such an element is used as intended. It will be further appreciated that for the purposes of the present invention, a distal designation surrounds a portion of an element being further from an operator when such an element is used as intended. Considering a firearm, for example as disclosed by Sturtevant, is appreciated to have a stock at a proximal end of the firearm and a barrel at a distal end of the firearm.

In certain embodiments of the present invention, a suppressor comprises a firearm engagement component at a proximal end of the suppressor. The firearm engagement component features a pathway along an attachment feature for the fixation to the muzzle-end of a firearm. The suppressor further comprises a projectile exit component at a distal end of the suppressor having an opening along a pathway allowing for the passage of a projectile and gasses. The suppressor further comprises a baffle system with a pathway disposed between the firearm engagement component and the projectile exit component, a sleeve, and an outer housing. Certain embodiments of a baffle system comprise a plurality of baffles. Certain embodiments of a baffle comprise a form of increasing cross-section with a pathway extending from the proximal end of the baffle to the distal end of the baffle. Such a pathway allows for the passage of a projectile through the suppressor without interference. Certain embodiments of such a baffle may further comprise apertures in the baffle through the outer surface of the baffle for the expansion of gasses and passage from a first volume on the interior of a baffle to a second volume on the exterior of a baffle. The baffle system is surrounded by the sleeve, which extends from a proximal portion of the suppressor to a distal portion of the suppressor. Gasses that pass from the first volume on the interior of a baffle, enter the second volume on the exterior of a baffle. The second volume is further defined by the interior surface of the sleeve. The sleeve serves to direct the expansion of gasses and may be configured to allow the passage of gasses from the second volume within the interior of the sleeve to a third volume external to the sleeve.

In certain embodiments a sleeve is configured to allow the passage and expansion of gasses from the second volume to the third volume via through-holes located toward the distal end of the suppressor. Gasses that enter the second volume from the first volume, expand parallel to the pathway and toward the distal end prior to passing through the throughholes. Gasses that expand into the third volume are initially contained between the outer surface of the sleeve and the inner surface of the outer housing. In certain embodiments, these gasses are permitted to expand within the third volume, between the sleeve and the interior surface of the outer housing, along the length of the suppressor toward the proximal end of the suppressor. Toward the proximal end of the suppressor, the outer housing has apertures extending through the outer surface of the outer housing to the ambient air, allowing for the venting of gasses associated with the operation of a firearm to the ambient air.

Certain embodiments of the present invention surround a suppressor having a plurality of individual parts assembled to result in a whole, as the production of a unitary suppressor requiring no further assembly produced using manufacturing processes such as additive manufacturing, or a combination thereof. It will be appreciated that additive manufacturing includes 3D printing such as Stereolithography, Digital Light Processing, Fused Deposition Modeling, Selective Laser Sintering, Selective Laser Melting, Electronic Beam Melting, Laminated Object Manufacturing, Binder Jetting, Material Jetting, and other manufacturing processes known to those skilled in the art.

It will be appreciated that the use of additive manufacturing allows for the combination of parts without traditional assembly methods. The combination of parts results in more robust components which thereby require less wall thickness, structural material, and bracing than a traditional suppressor which is assembled from a plurality of parts. Thus, the resulting suppressor can be manufactured at reduced weight, thereby reducing accelerated fatigue of operators. Furthermore, the elimination of assembly steps results in a decrease of cost associated with assembly, and a decrease in cost associated with assembly errors.

It will be further appreciated that a unitary suppressor cannot be disassembled and as such prevents inadvertent assembly errors in production. A unitary suppressor also prevents disassembly in the field which prevents the potential for lost parts as well as the potential for errors in reassembly. In certain embodiments the suppressor comprises (a) an outer housing; and (b) a unitary component comprising a first component, a second component, an endcap, a sleeve, and a firearm engagement component. Such embodiments allow for the removal of the outer housing and soaking the unitary component in solvent for cleaning purposes.

In certain embodiments a suppressor includes a first component aligned with the flight path along which a projectile travels when exiting a firearm. The first component has a pathway aligned with the flight path of the projectile and has a substantially cylindrical form. The substantially cylindrical form has an opening extending radially from the pathway to an external aspect. The opening resembles a helical form and serves to distribute the gasses which enter the pathway along the length of the first component in an outward direction. The helical form allows the distribution of gasses radially outward while mitigating a flow velocity loss and localized pressure concentration of the gasses. In certain embodiments, the use of a helical opening in association with a first component results in inducing the gasses into a vortex flow. In certain embodiments, vortex flow is beneficial as it encourages increased mixing and turbulent flow.

In certain embodiments, a second component, having a substantially cylindrical from has an internal aspect configured to receive the first component wherein the second component is disposed around the first component. The second component has apertures which align with the helical opening of the first component. Thus, as the gasses proceed through the helical opening of the first component, they are permitted to pass radially through the apertures of the second component. The second component has a series of channels in the external aspect of the second component which extend from the aperture toward the distal aspect of the second component.

In certain embodiments comprising a second component, gasses flow through the apertures of the second component and flow in a distal direction toward a distal aspect of the second component. The gasses are received from the channels into recesses of an endcap which are configured to allow the gasses from multiple channels to intermix and expand.

In certain embodiments a sleeve disposed around the second component prevents the intermixing of gasses between channels until after exiting the channels into their respective recesses in the endcap. The sleeve bifurcates the recesses of the endcap, thus allows the gasses to flow into the recesses from the channels of the second component and proceed further downstream. In certain embodiments, an outer housing is disposed around the sleeve wherein an internal aspect of the outer housing is offset from an external aspect of the sleeve, thereby resulting in a volume contained between the sleeve and the outer housing. The gasses flow into the recesses from the channels of the second component, and flow from the recesses into the volume contained between the sleeve and the outer housing back toward a proximal aspect of the suppressor. The gasses then flow toward a proximal aspect of the suppressor.

In certain embodiments, the external aspect of the sleeve includes protuberances which act to restrict the flow of the gasses. These flow restrictors act to limit the flow velocity of gasses from the distal aspect of the suppressor back toward the proximal aspect within the volume between the sleeve and outer housing. By limiting the velocity of gasses to less than 335 m/s (1100 ft/s), supersonic gas velocities are mitigated thus preventing a loud audible report, often referred to as a "supersonic crack" or simply a "crack." The gasses then expand through apertures in the outer housing. The apertures in the outer housing are typically located at a proximal aspect of the suppressor and extend from the internal aspect of the outer housing, through an external aspect of the outer housing. Thus, when the gasses expand through the apertures in the outer housing, they expand radially outward into the ambient air surrounding the suppressor.

It is an aspect of the present invention to provide firearm suppression while mitigating negative effects on the projectile. Typical existing suppressors provide a pathway for a projectile to travel through while providing a volume for the gasses associated with the firearm to expand into. Some existing suppressors comprise a volume surrounding the pathway wherein the gasses from the firearm expand radially into the surrounding volume. In such examples, the gasses which expand radially outward into the surrounding volume are not prevented from reentering the pathway. Thus, the gasses rapidly expand and are permitted to reenter the pathway creating unwanted flow patterns within the pathway. Such flow patterns of the gasses reentering the pathway are known to impact the ballistic performance of the projectile. In some scenarios, the gasses reentering the pathway can affect the flight path of the projectile and change the point of impact (POI). The point of impact shift when installing a suppressor to a weapon can result in point of impact shift by multiple minutes of angle (MOA). It will be appreciated that a minute of angle is an angular measurement wherein a minute of angle is equal to $1/60^{th}$ of a degree. Over a range of 91.44 m (100 yd), one minute of angle equates to 2.66 cm (1.047 in)—however it is commonly estimated as "1-inch per 100 yards." It is an aspect of the present invention to limit the point of impact shift to less than 1 minute of angle, and in some embodiments a point of impact shift of near to or equal to zero.

Because the use of a suppressor is known to affect the point of impact, it is common practice to re-zero or recalibrate any optics or to simply compensate with aim to achieve a similar point of impact. It will be appreciated that it is advantageous to be able to attach or remove a suppressor from/to a firearm without affecting the point of impact. It is an aspect of the present invention to allow the rapid attachment and removal of a suppressor to/from a firearm while impacting the point of impact by less than one minute of angle.

These and other advantages will be apparent from the disclosure of the inventions contained herein. The above-described embodiments, objectives, and configurations are neither complete nor exhaustive. As will be appreciated, other embodiments of the invention are possible using, alone or in combination, one or more of the features set forth above or described in detail below. Further, this Summary is neither intended nor should it be construed as being representative of the full extent and scope of the present invention. The present invention is set forth in various levels of detail in this Summary, as well as in the attached drawings and the detailed description below, and no limitation as to the scope of the present invention is intended to either the inclusion or non-inclusion of elements, components, etc. in this Summary. Additional aspects of the present invention will become more readily apparent from the detailed description, particularly when taken together with the drawings, and the claims provided herein.

BRIEF DESCRIPTION OF FIGURES

FIG. 1B—A perspective exploded cross-section view of an embodiment of a suppressor FIG. 2—A perspective view of an embodiment of a suppressor FIG. 3A—A perspective exploded view of an embodiment of a baffle FIG. 3B—A perspective exploded cross-sectional view of an embodiment of a baffle FIG. 4—A perspective cross-sectional view of an embodiment of a baffle system FIG. 5A—A perspective cross-sectional view of an embodiment of a suppressor FIG. 5B—A perspective exploded cross-sectional view of an embodiment of a suppressor FIG. 5C—A perspective exploded cross-sectional view of an embodiment of a suppressor FIG. 6—A perspective view of an embodiment of a suppressor FIG. 7—A side cross-sectional view of an embodiment of a suppressor FIG. 8A—An exploded perspective view of certain embodiments of a suppressor FIG. 8B—An assembled perspective view of certain embodiments of a suppressor FIG. 9A—A perspective view of certain embodiments of a first component of a suppressor FIG. 9B—A side view of certain embodiments of a first component of a suppressor FIG. 10A—A perspective view of certain embodiments of a suppressor comprising a first component and a second component FIG. 10B—A perspective view of certain embodiments of a suppressor comprising a first component and a second component FIG. 10C—A side view of certain embodiments of a second component of a suppressor FIG. 10D—A perspective view of certain embodiments of a second component of a suppressor FIG. 10E—Section view A-A of FIG. 10C FIG. 10F—Section view B-B of FIG. 10C FIG. 11—A perspective view of certain embodiments of an endcap of a suppressor FIG. 12A—A perspective view of certain embodiments of a suppressor comprising a first component, a second component, a sleeve, and an endcap FIG. 12B—An end view of certain embodiments of a suppressor comprising a first component, a second component, a sleeve, and an endcap FIG. 12C—A perspective view of certain embodiments of a sleeve FIG. 12D—An end view of certain embodiments of a sleeve FIG. 12E—A perspective view of certain embodiments of a suppressor comprising a sleeve, an endcap, and a firearm engagement component.

DETAILED DESCRIPTION

Figure 1A:
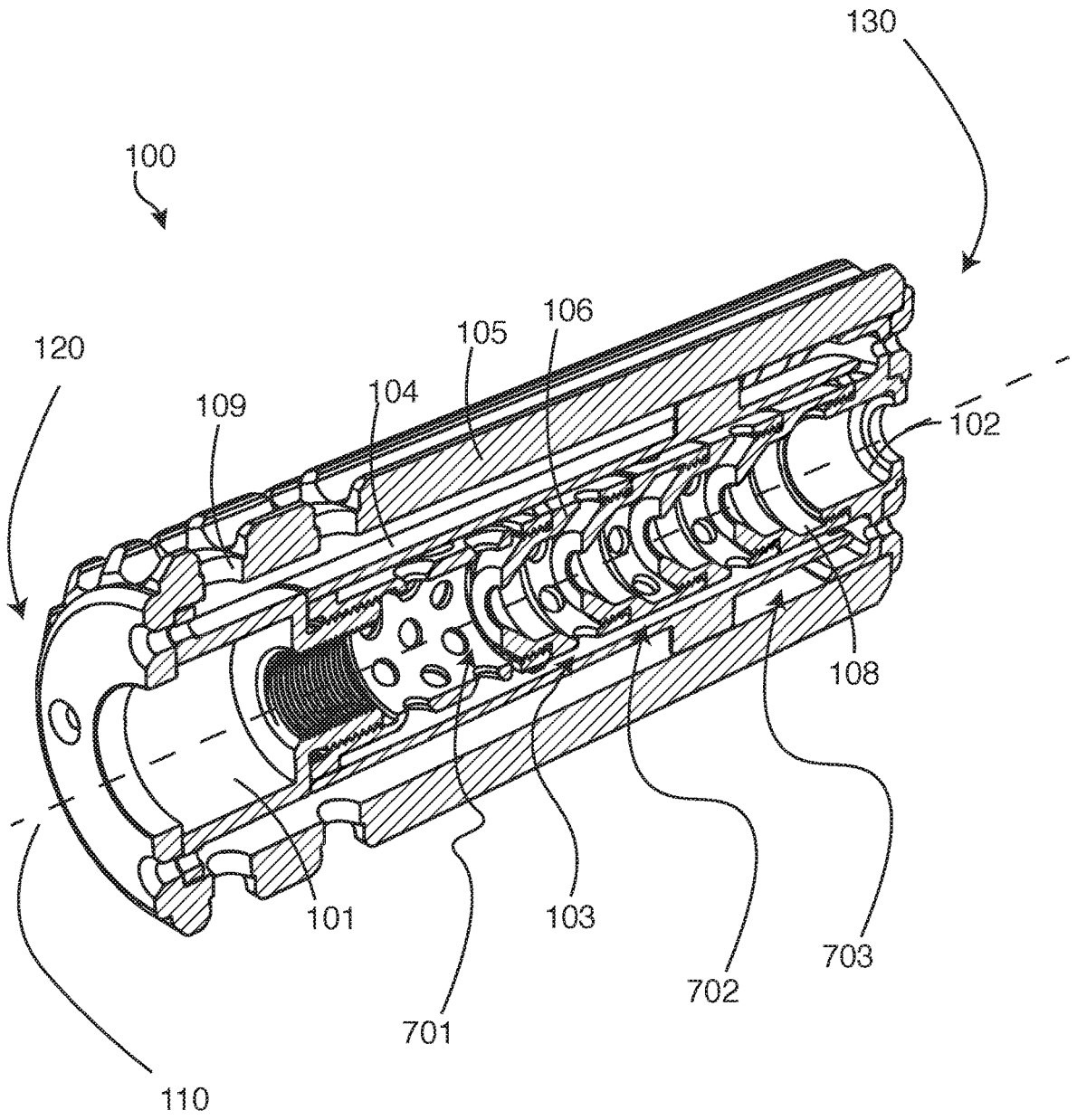
FIG. 1A—A perspective cross-sectional view of an embodiment of a suppressor
Figure 1B:
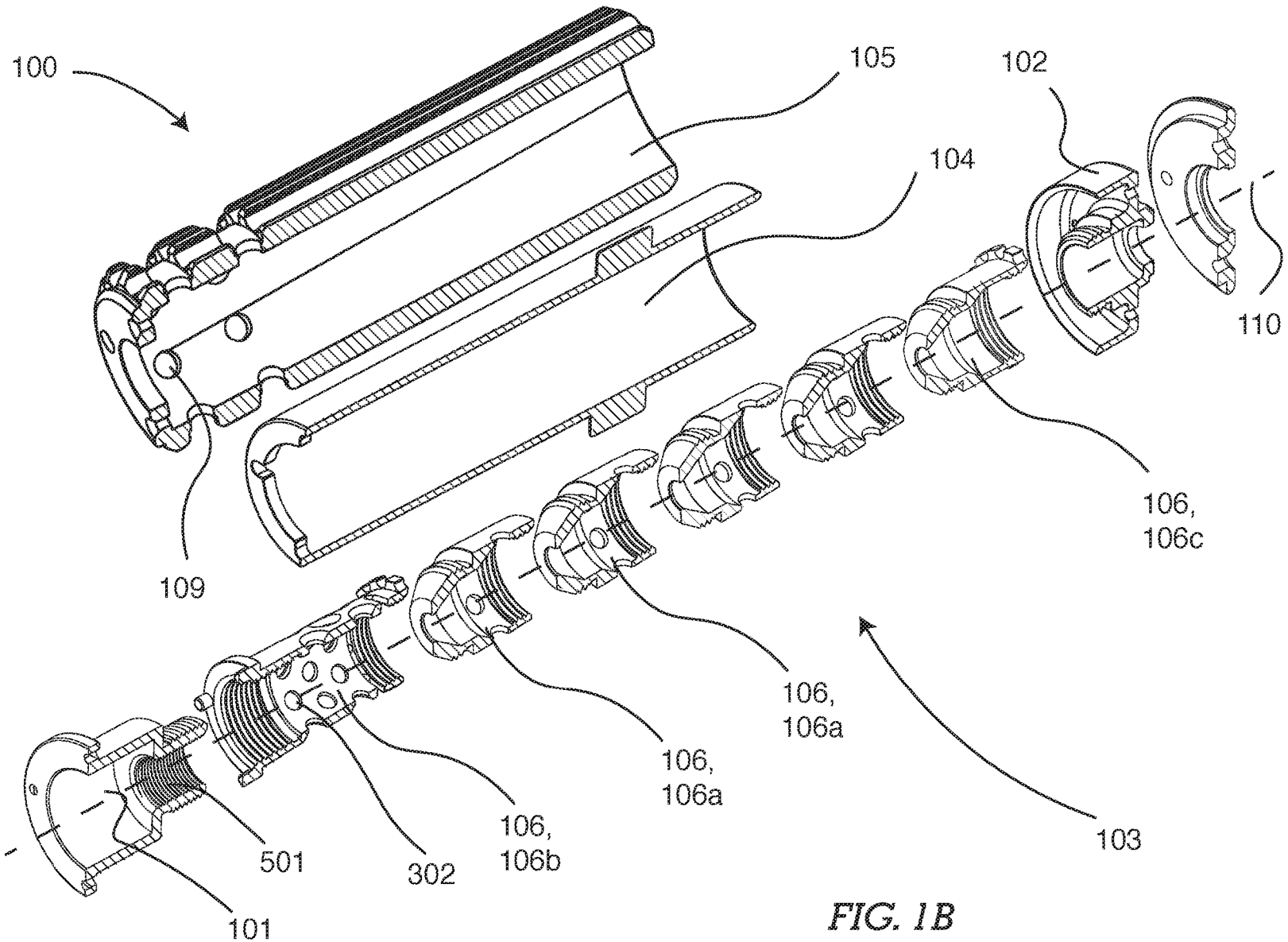

Certain embodiments of the present invention surrounding a suppressor 100, as shown in FIG. 1A and FIG. 1B, comprise a firearm engagement component 101 having a pathway 110 and a firearm attachment feature 501 for the fixation to a distal end of a firearm. Such a suppressor 100 has a proximal end 120 and a distal end of the suppressor 130 and further comprises a projectile exit component 102, a baffle system 103, a sleeve 104 and an outer housing 105. A projectile exit component 102 is open along a pathway 110, allowing for the passage of a projectile and gasses. Certain embodiments of a baffle system 103 comprise a plurality of interconnected baffles 106. A first baffle 106*a*, seen in FIG. 1B, comprises a hollow form with a cross-section increasing along the pathway 110 from a proximal end toward a distal end of the first baffle 106. A second baffle 106*b*, seen in FIG. 1B, comprises a constant internal diameter and constant outer diameter. The first baffle 106*a* and the second baffle 106*b* are interconnected such that the hollow form of each is consistent with the pathway 110. The outer surface of certain baffle, 106*a* and 106*b* for example, have apertures 302 in the baffle through an outer surface of the baffle for the expansion of gasses from the interior of the baffle system 103 to the exterior of the baffle system 103. A third baffle 106*c*, seen in FIG. 1B, comprises a hollow form with increasing cross-section along the pathway 110 from a proximal end toward a distal end of the third baffle 106*c*.

It will be appreciated that embodiments of baffle 106, shown in FIG. 1B, are not limited to the configuration disclosed and may comprise any form or cross-section having a hollow form aligning with the pathway 110. The alignment of the hollow form of a baffle 106 allows the passage of a projectile from a proximal portion of the baffle system 103 to a distal portion of the baffle system 103 without interference.

It will be further appreciated that a baffle system 103, shown in FIG. 1B is not limited to configurations disclosed herein and may comprise any combination of baffle 106 without departure from the inventive concept of the present invention. Certain embodiments of a baffle system 103, may contain a plurality of baffles 106. Other embodiments of a baffle system 103 may comprise a singular baffle 106.

Certain embodiments of a baffle system 103, seen in FIG. 1A, are surrounded by a sleeve 104, which extends from a proximal portion of the suppressor 100 to distal portion of the suppressor 100. Gasses that pass from the first volume 701, through the baffle system 103, enter the second volume 702. The second volume 702 is bounded by the internal surface of the sleeve 104 and the external surface of baffle system 103. The sleeve 104 only allows the passage of gasses from the interior of the sleeve 104 to the exterior of the sleeve 104 at a location near the distal end of the suppressor 100. The gasses that pass to the exterior of the sleeve 104 are initially contained within a third volume 703 defined by the external surface of the sleeve 104 and the inner surface of the outer housing 105. These gasses are permitted to expand within the third volume 703 between the sleeve 104 and the outer housing 105 along the length of the suppressor 100 toward the proximal end 120 of the suppressor 100. Near the proximal end 120 of the suppressor 100, the outer housing 105 has apertures 109 in the outer housing to the ambient air, allowing for the exit of gasses associated with the operation of a firearm.

Although embodiments presented herein, as shown in FIG. 1A for example, surrounding the present invention are configured with a first volume 701, a second volume 702 and a third volume 703, it will be appreciated that additional volumes may be considered as within the inventive bounds of a suppressor as disclosed.

Figure 2:
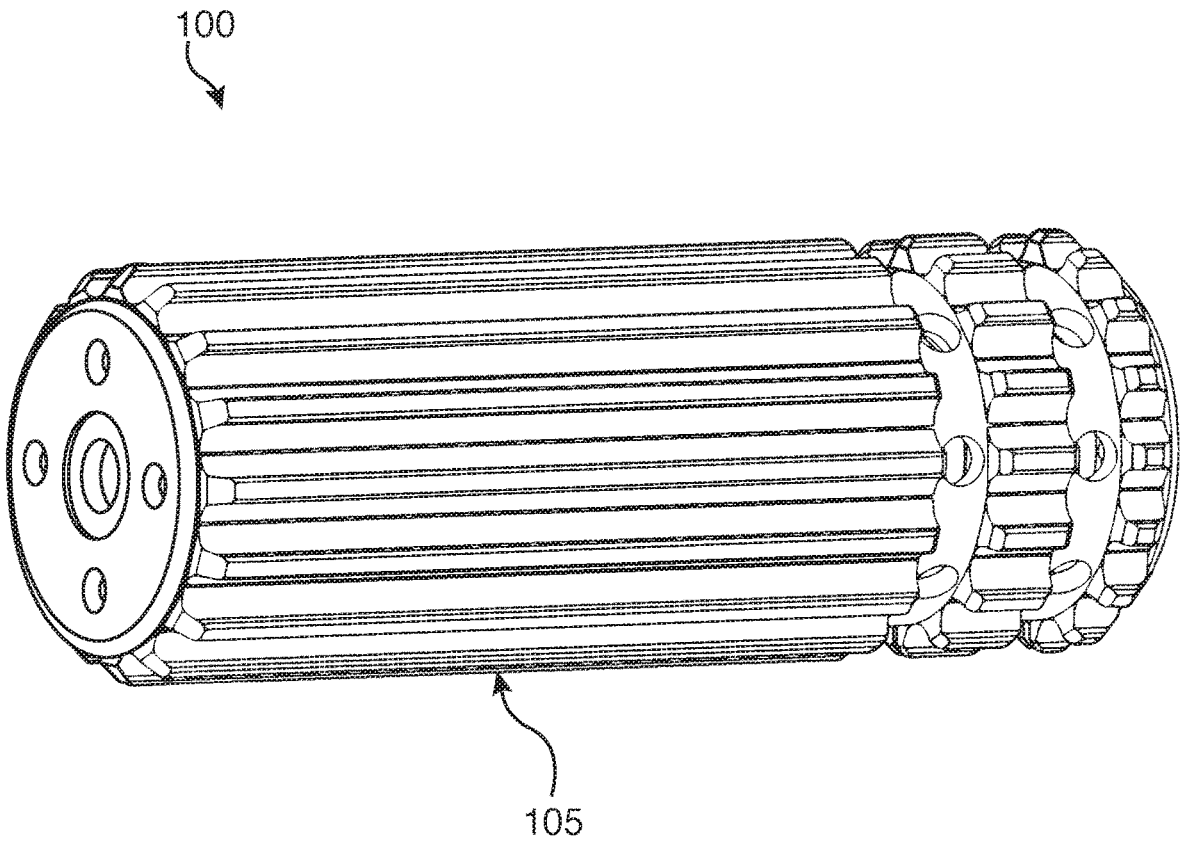
Figure 3A:
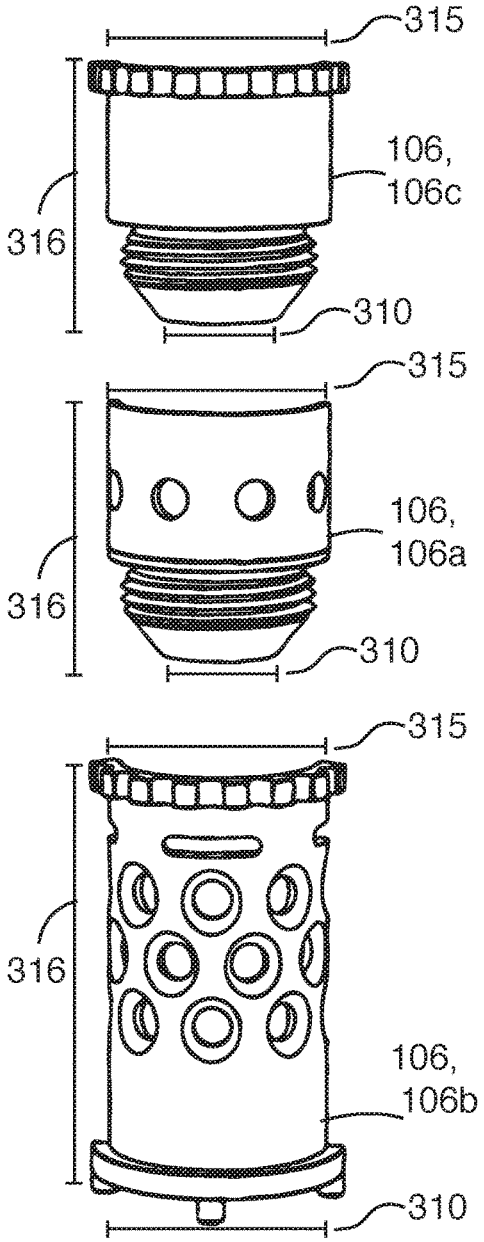
Figure 3B:
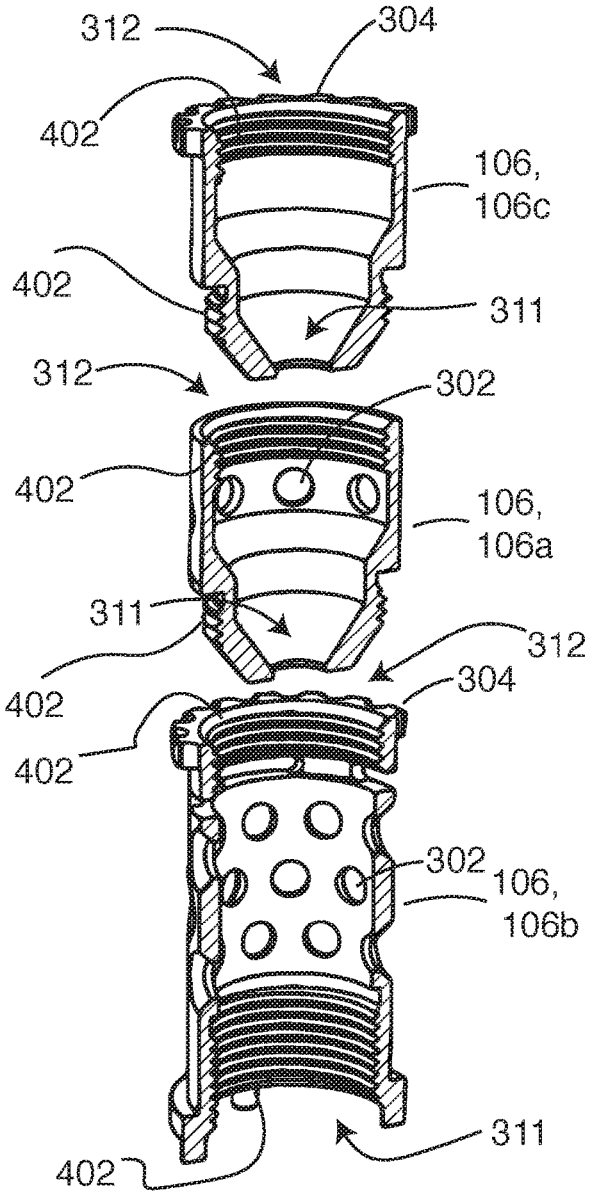

Certain embodiments of a suppressor 100, as shown in FIG. 2, comprise an outer housing 105 further comprising a material composition with a low heat transfer coefficient. Such material compositions may comprise ceramic, polymeric or other materials with a low heat transfer coefficient. Such materials further exhibit a melting temperature and heat deflection temperature, as dictated by the American Society of Testing and Materials (ASTM), exceeding 500° C. (932° F.). Certain embodiments of a baffle system 103, as shown in FIG. 3A and FIG. 3B, comprise a plurality of baffles 106, each having a first dimension 310, a second dimension 315 and a length 316. It will be appreciated that in certain embodiments of some baffle (106*a*, 106*c*), a first dimension 310 is smaller than a second dimension 315. In other embodiments of a baffle 106*b* a first dimension 310 may be equal to a second dimension 315. Furthermore, each baffle 106 has a proximal opening 311 and a distal opening 312. A first baffle 106*a* for instance, comprises a hollow form with increasing cross-sectional dimension, from a first dimension 310 at a proximal portion of the first baffle 106*a* to a second dimension 315 at an open distal portion of the first baffle 106*a*. The proximal portion of the first baffle 106*a* has a proximal opening 311, less than or equal to the first dimension 310. The first baffle is configured such that gasses may pass axially into, expand through the baffle 106*a*, and exit through a distal opening 312 at a distal portion of the baffle 106*a*. Furthermore, such a first baffle 106*a* comprises apertures in the baffle 302 extending radially through the hollow form of the baffle 106*a*. Such apertures in the baffle 302 are typically biased toward a distal portion of the baffle 106. Apertures in a baffle 302 allow for the passage of gasses from the internal volume of a baffle 106*a* to the exterior of a baffle 106*b*.

As shown in FIG. 3A and FIG. 3B, it will be appreciated that a baffle 106 may take a plurality of forms as shown in FIG. 3A and FIG. 3B. It will be further appreciated that certain embodiments of a baffle 106, such as a third baffle 106*c*, do not require apertures in the baffle.

In certain embodiments, as seen in FIG. 3A and FIG. 3B, some baffles (106*b*, 106*c*) have at least one baffle standoff feature 304, extending radially outward from the exterior surface of the baffle 106*b* and 106*c*. Baffle standoff features 304 as seen in FIG. 3B, provide offset between a baffle 106 or baffle system 103, and a sleeve 104 as shown in FIG. 1B. Certain embodiments of a baffle standoff feature 304, shown in FIG. 3B, are positioned toward a distal portion of a baffle 106. A baffle standoff feature 304 may comprise a continuous form, a continuous form with apertures for the passage of gas allowing for expansion, or a plurality of individual features extending radially from the outer surface of a baffle 106.

In other embodiments as shown in FIG. 3A and FIG. 3B, a baffle 106*b* comprises a cylindrical shell form with constant cross-sectional dimension and open ends. The cylindrical shell features apertures in the baffle 302 passing through the external surface of the baffle 106*b* to the interior of the cylindrical shell form. The apertures in the baffle 302 may be evenly spaced, staggered or randomly positioned and allow for the passage of gasses from the interior of the baffle 106*c* to the exterior of the baffle. Furthermore, a baffle 106*c* may comprise alternative embodiments of apertures in the baffle 302 having differing shape and cross-sectional area.

It will be appreciated to one skilled in the art that expansion rate of a gas associated with a baffle 106, seen in FIG. 3A, is dependent upon multiple variables including the cross-sectional area of the baffle along the length of the baffle 106, apertures in the baffle 302 shape, number of apertures in the baffle 302 allowing passage to the exterior of the baffle and the length of a baffle 106.

Figure 4:
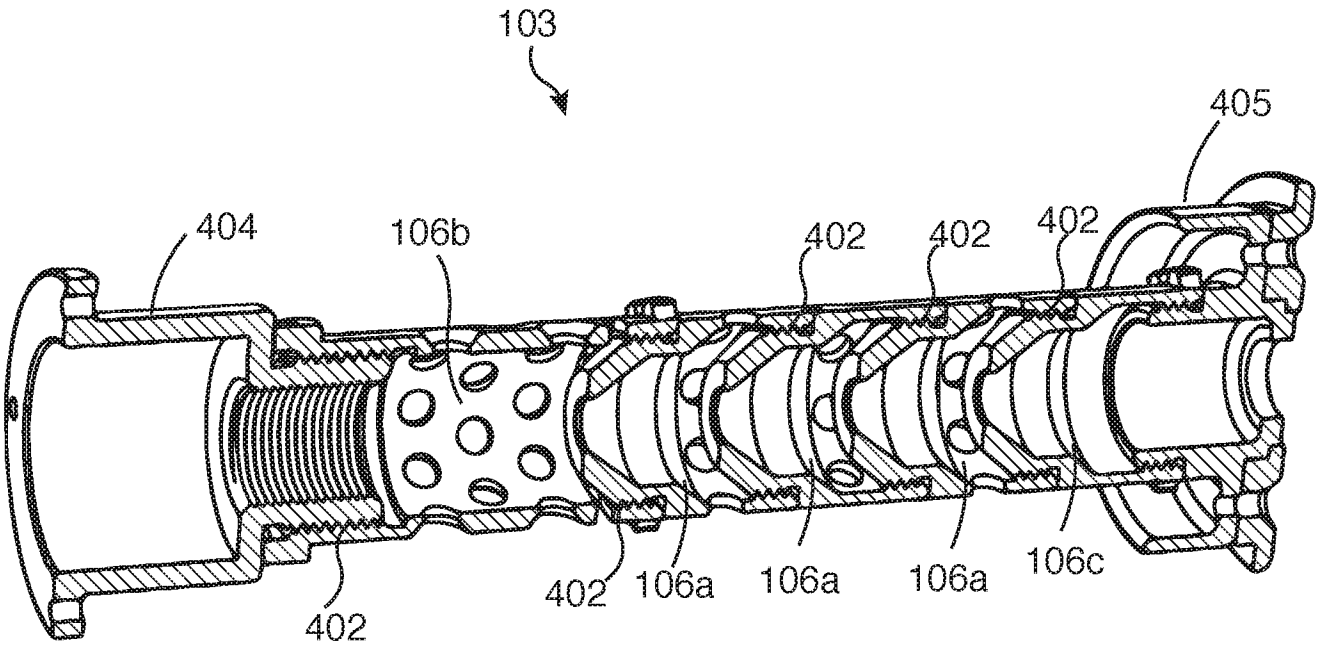

In certain embodiments of a baffle system 103 as shown in FIG. 4, a baffle 106 may further comprise baffle attachment features 402 for the fixation of the baffle 106 to other components including, but not limited to other baffle 106*a*, 106*b* and 106*c*, a firearm engagement component 404 of a suppressor or a projectile exit component 405 of a suppressor. Such attachment features include screw threading, pipe threading, male or female interlocking mechanisms. As seen in FIG. 3B, certain embodiments of a baffle 106 comprise a baffle attachment feature 402 at a proximal portion and a distal portion of such a baffle 106. Such baffle attachment features 402 allow the assembly and disassembly of a plurality of baffles 106.

Figure 5A:
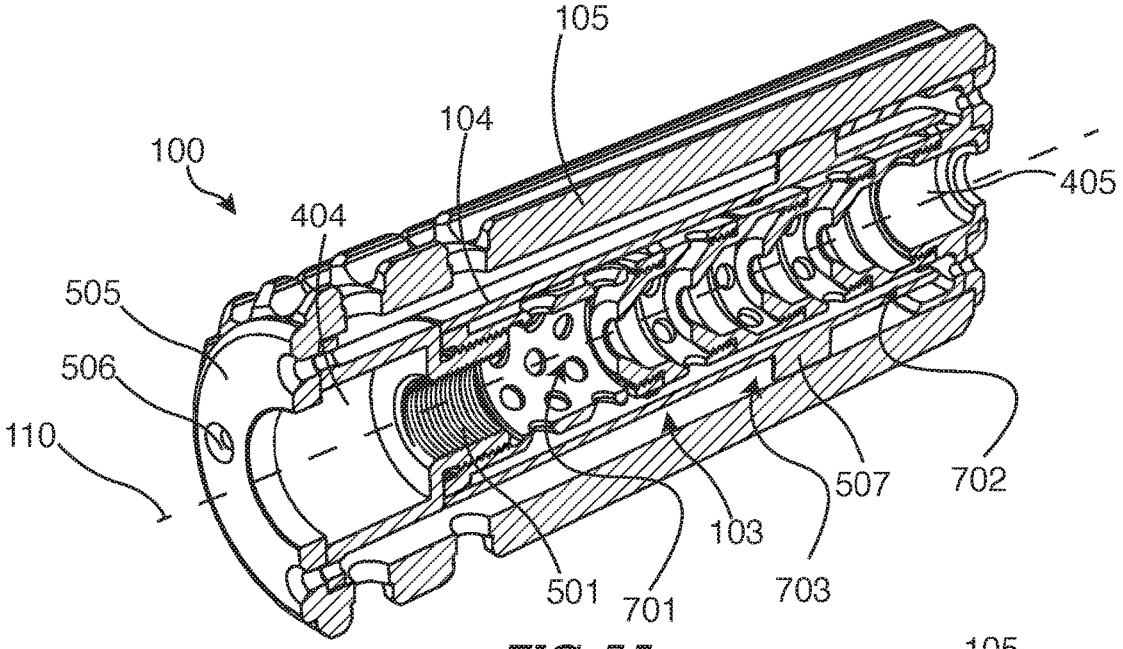
Figure 5B:
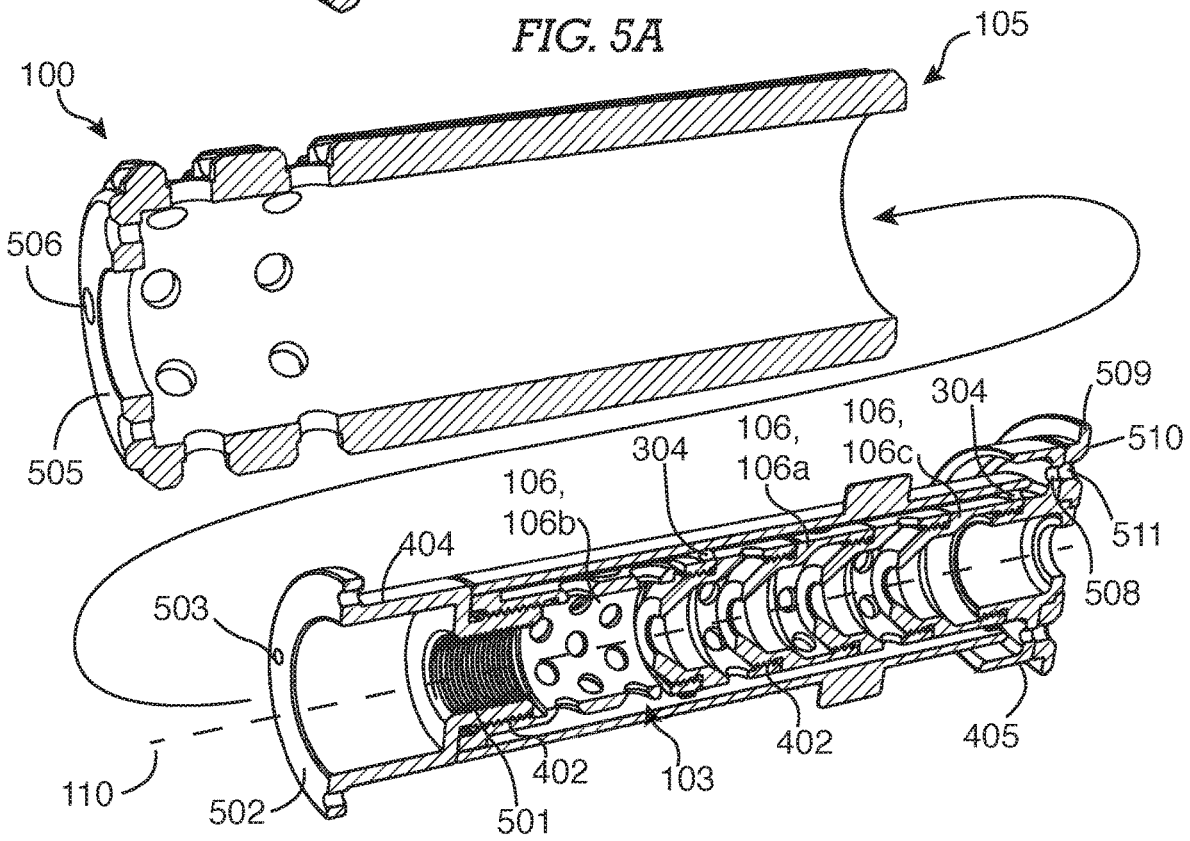

Certain embodiments of a baffle system 103, as shown in FIG. 5A and FIG. 5B, comprise a sleeve 104, a firearm engagement component 404, a projectile exit component 405 and an outer housing 105. The firearm engagement component, seen in FIG. 5B and FIG. 5C, 404 further comprises a projectile entry aperture 307 and a firearm attachment feature 501 for the fixation to the distal end of a firearm, and proximal face 520 comprising a flange feature 502 extending radially outward with a plurality of through-holes 503 in the firearm engagement component flange feature 502.

A suppressor 100, shown in FIG. 5B, further comprises a baffle system 103 having a plurality of axially affixed baffle 106 wherein the baffles 106 are attached to each other using baffle attachment features 402. The baffles 106 are configured to allow radial gas expansion as gasses flow along a pathway 110 through each consecutive baffle 106 and therein from proximal portion to a distal portion of the baffle system 103. A second baffle 106*b* at the proximal end 120 of the suppressor 100 further comprises a proximally located attachment feature 402 for fixation to the firearm engagement component 404 of the suppressor 100 and at least one baffle standoff feature 304. A third baffle 106*c* at the distal end of the suppressor 130 further comprises a distally located baffle attachment feature 402 for fixation to the projectile exit component 405 of the suppressor 100 and at least one baffle stand-off feature 304. A plurality of first baffles 106*a* are interconnected and extend from the second baffle 106*b* to the third baffle 106*c*. The projectile exit component 405, shown in FIG. 5C, further comprises a flange feature 504 extending radially outward. In some embodiments, the baffle stand-off features 304 of the most proximal baffle 106*c* and the most distal baffle 106*b* of the baffle system 103 provide support for the sleeve 104 disposed around the baffle system. The baffle stand-off features 304 offset the sleeve 104 at a consistent distance from the pathway 110 of the suppressor 100.

Figure 5C:
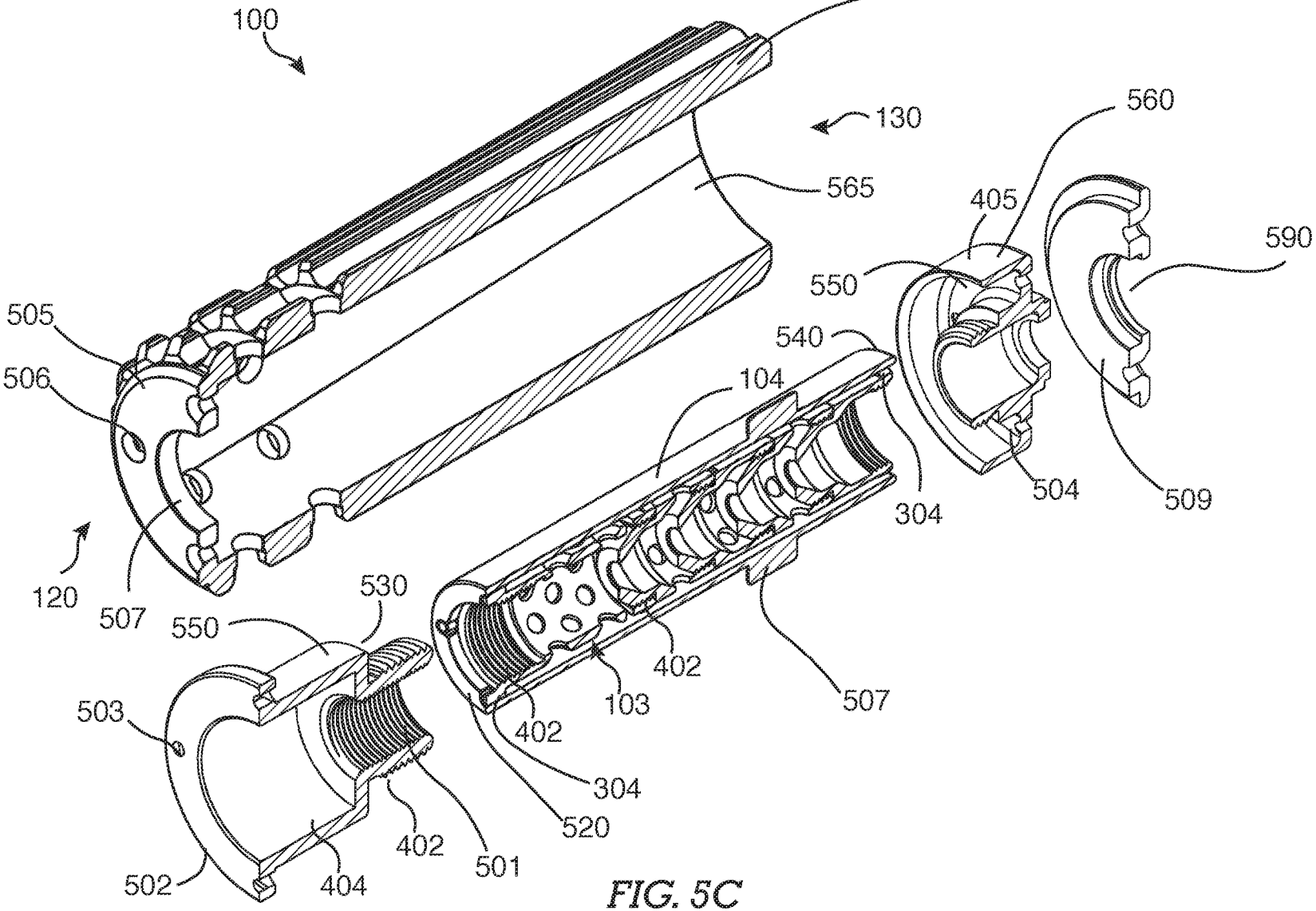

In certain embodiments of a suppressor as seen in FIG. 5C, a proximal face 520 of a sleeve 104 interfaces with a distal face 530 of the firearm engagement component 404 for fixation to each other. This fixation seals the intersection of the sleeve 104 and the firearm engagement component 404 to prevent the passage of gasses from between the sleeve 104 and the firearm engagement component 404. A distal edge 540 of the sleeve 104 is offset from a proximal face 550 of the projectile exit component 405. Offsetting the sleeve 104, referencing FIG. 5A, from the firearm engagement component 104 allows the passage of gasses between a second volume 702 within of the sleeve 104 to a third volume 703 defined by the exterior of the sleeve 104 and the interior surface of the outer housing 105. The outer housing 105, shown in FIG. 5B, and FIG. 5C, comprises a cylindrical shell-form open at a distal end of the suppressor 120 and an aperture at the proximal end of the suppressor 130. A flange feature 505 configured proximally on the outer housing 105 extends radially inward from the cylindrical shell form. The flange feature 505 further exhibits an aperture 506, which is typically centrally located. The flange feature 505 of the outer housing 105 has through-holes 506 of configuration matching through-holes 503 of the firearm engagement component 404 flange feature 502. The outer housing 105 is disposed surrounding the assembly of the firearm engagement component 404 and the projectile exit component 405, with baffle system 103 and sleeve 104 therebetween. In such an assembly the outer housing flange feature through-holes 506 align with the through-holes in the flange feature of the firearm engagement component 503.

In certain embodiments of a suppressor, shown in FIG. 5C, an outer surface 550 of a firearm engagement component 404 flange feature 502 and an outer surface 560 of a projectile exit component 405 provide engagement with the interior surface 570 of an outer housing 105 for axial constraint. Optionally, the sleeve 104 may further comprise offset features for engagement with the interior surface 565 of the outer housing 105 for additional axially constraint. Referencing FIG. 5B and FIG. 5C, fastening hardware inserted through the aligned outer housing flange feature through-holes 506 and the through-holes in the flange feature of the firearm engagement component 503 provide longitudinal constraint. Optionally, the projectile exit component flange feature 504 may further comprise a plurality of through-holes 508, wherein an end-cap 509, intended to provide more structural constraint stability and/or gas sealing, further comprises a flange feature 510. The end-cap flange feature 510 has a projectile exit aperture 590 aligning with a pathway 110 and a baffle system 103 and further comprises a plurality of through-holes 511. The through-holes 511 of the end-cap 509 flange feature 510 matching the configuration of the projectile exit component flange feature through-holes 508 intended for the engagement of fastening hardware. Engagement of fastening hardware through the aligned through-holes 508 and 511 constrains an end-cap 509 to the projectile exit component 405.

Figure 6:
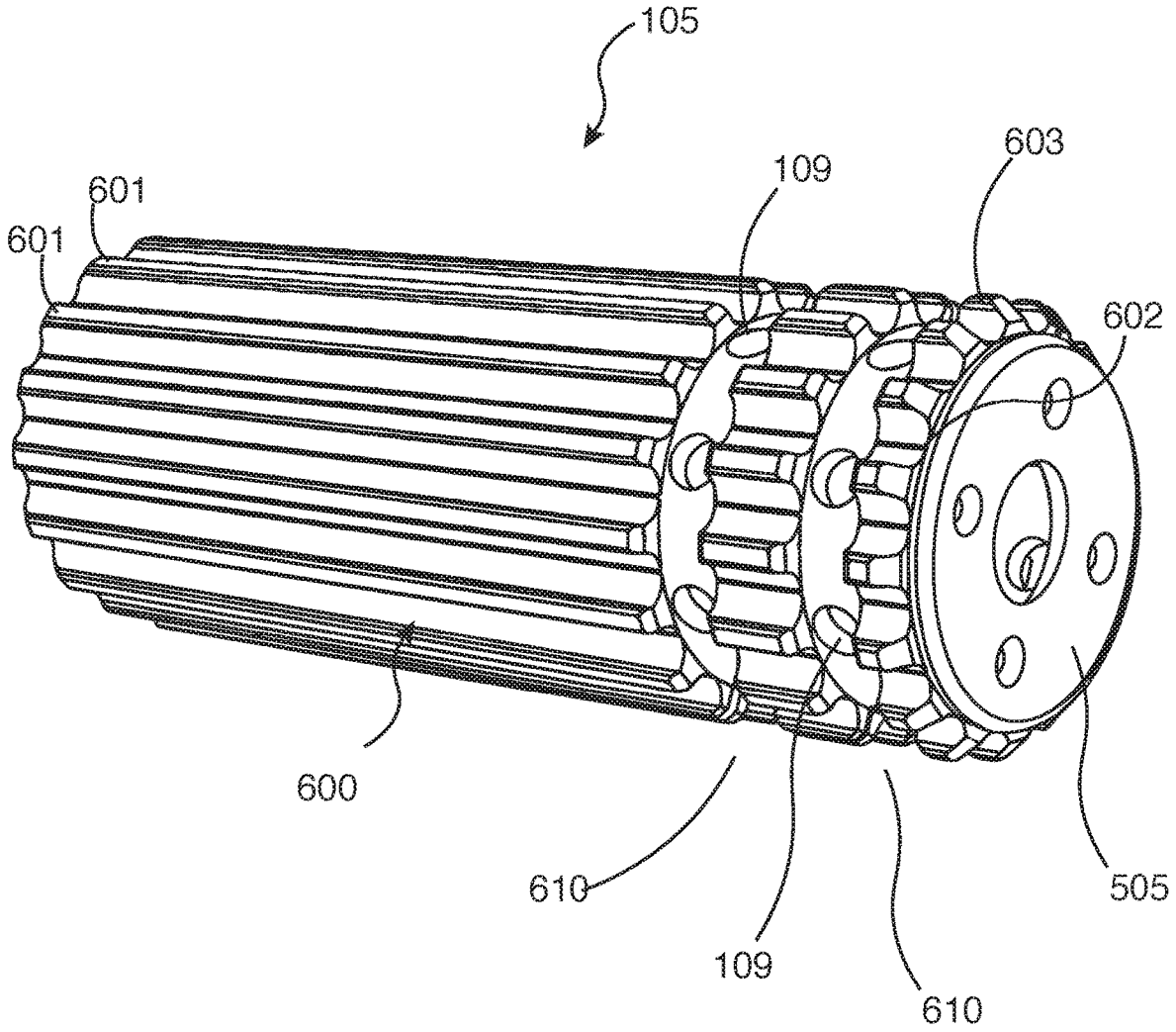

In certain embodiments, outer housing 105, shown in FIG. 6 further comprises at least one aperture 109 in the outer housing. Other embodiments of an outer housing 105 comprise a plurality of apertures 109 in the outer housing offset from a distal portion of the outer housing 105. Such apertures 109 in the outer housing extend from the exterior to the interior of the outer housing 105. In some embodiments, a plurality of apertures 109 in the outer housing are used. In such embodiments, the apertures 109 in the outer housing are typically configured in a plurality of radial planar patterns 610, with each radial planar pattern 610 parallel to the outer housing flange feature 505. The radial planar patterns 610 of apertures 109 in the outer housing are typically offset from each other and proximate to the proximal end of the outer housing 105. It will be appreciated that any configuration of a plurality of apertures 109 in the outer housing may be used.

In certain embodiments of a suppressor 100 as shown in FIG. 6, the exterior surface 600 of an outer housing 105 comprises a plurality of geometric features 601 extending radially away from the external surface 600 of the outer housing 105. It will be appreciated that such geometric features 601 further comprise a minimum external profile 602, more proximate to the outer housing 105 external surface 600. Under normal operating use, the minimum external profile 602 will typically exhibit a higher surface temperature than a maximum profile area 603. It will be further appreciated that a maximum external profile 603 is offset radially outward from the outer housing 105 external surface 600. Outer housing 105 geometric features 601 provide benefits including but not limited to increased heat mitigation and offset surface providing a lower temperature user interface surface to mitigate burns and other potential injury. It will be appreciated that such geometric features 601, as shown in FIG. 6, are not limited to the embodiments as shown. Geometric features 601 may comprise a number of shapes, sizes and configurations while remaining consistent with the inventive nature of the present invention.

It will be appreciated that an increase in number of apertures 109 in the outer housing as shown in FIG. 6, or an increase of cross-section of an aperture 109 in the outer housing serves to increase gas exit airflow. It will be further appreciated that apertures 109 in the outer housing are not limited to a configuration involving two radial planar patterns 610 and may be configured in any configuration appreciated by one skilled in the art. This may include, but is not limited to, an array configuration, a randomized configuration or a spiral configuration.

Figure 7:
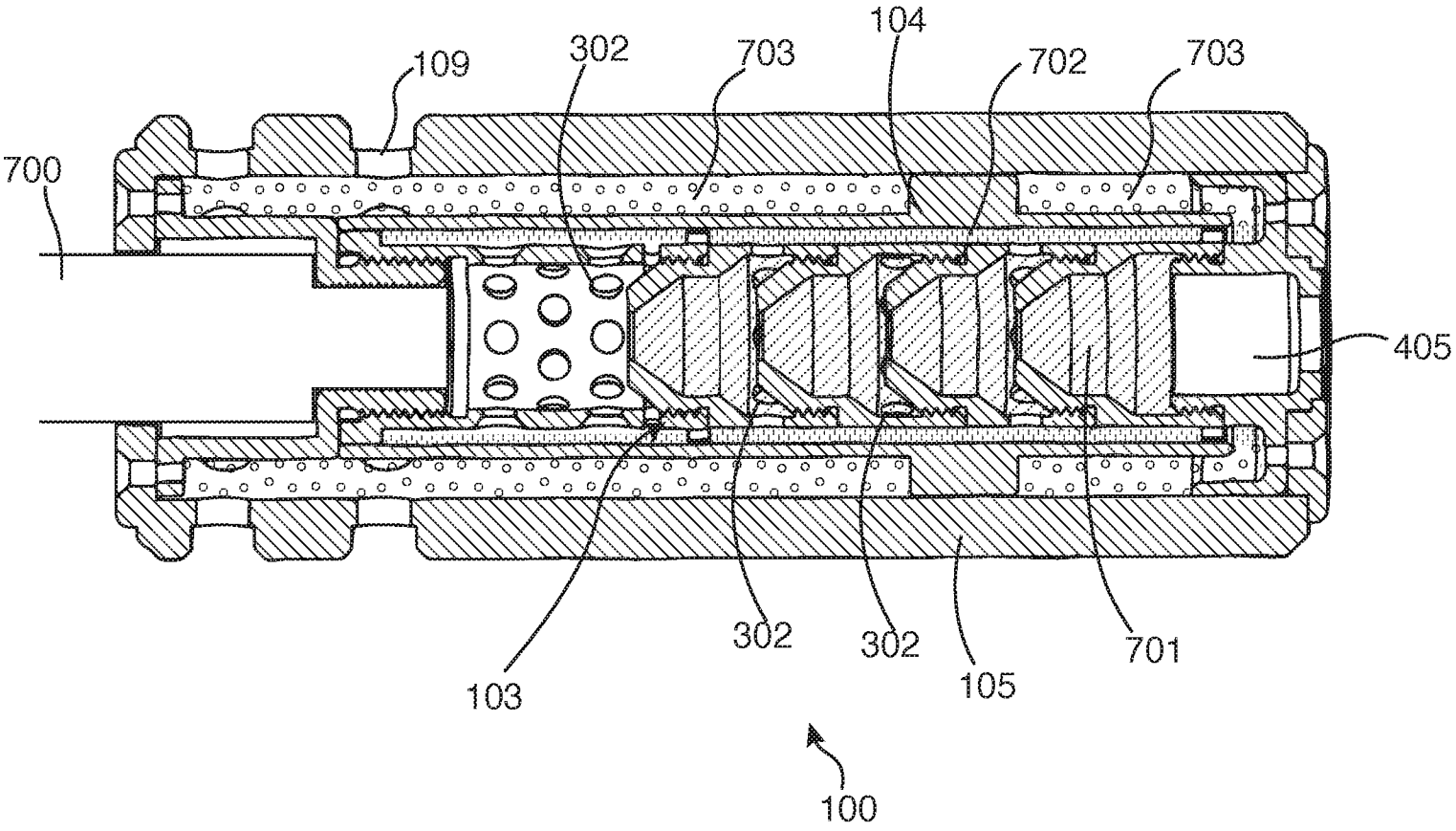

In certain embodiments of the invention shown in FIG. 7, a suppressor 100 comprises three internal gas expansion volumes defined by the assembly of a suppressor 100. A first volume 701 comprises the internal volume of a baffle system 103. A second volume 702 comprises the volume between the exterior surface of a baffle system 103 and the internal surface of a sleeve 104. A third volume 703 comprises the volume between the external surface of a sleeve 104 and the internal surface of an outer housing 105. When a firearm 700 to which the suppressor 100 is affixed is fired, gasses expand from the distal end of a firearm 700 into the suppressor 100, the gasses expand axially along the length of the first volume 701 toward the distal end of the suppressor 120. At the distal end of the suppressor 130, while expanding radially into the second volume 702 through apertures in the baffle 302. Some gasses exit the suppressor 100 through a projectile exit component 405 while other gasses expand into the second volume 702. The gasses expanding through the second volume 702, expand toward the distal end 130 of the suppressor where an offset of the distal edge of the sleeve 104 from a proximal planar surface of the projectile exit component 405 allows the expansion of gasses from the second volume 702 into the third volume 703. Gasses expand from the distal end of the third volume 703, toward the proximal end 120 of the suppressor 100. Apertures 109 in the outer housing in the outer housing 105 allow the expansion of gasses from the third volume 703 to the surrounding environment.

Figure 8A:
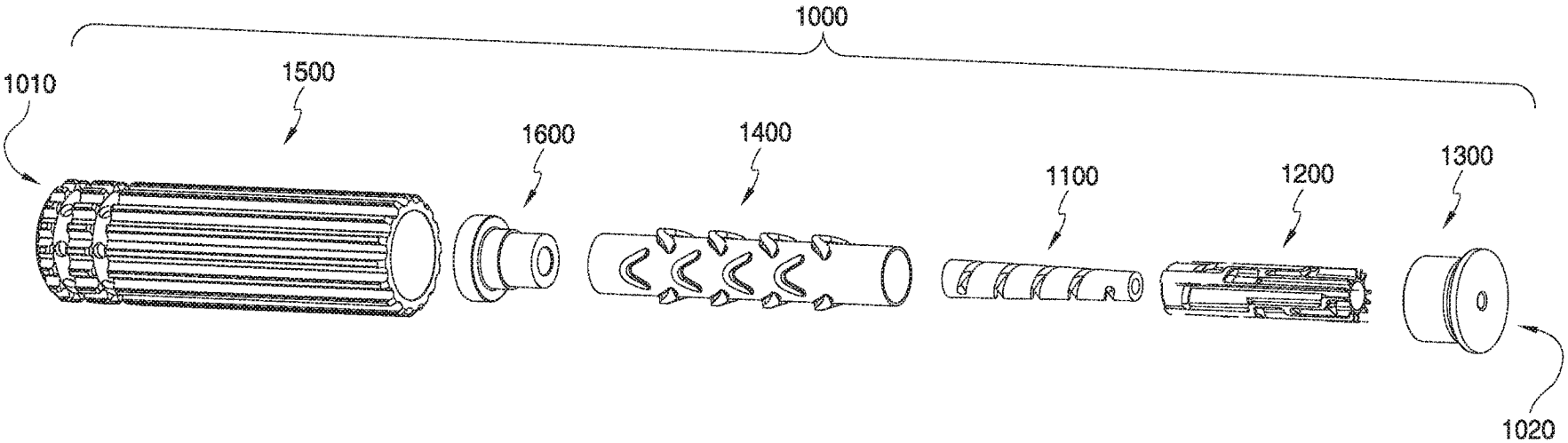
Figure 8B:
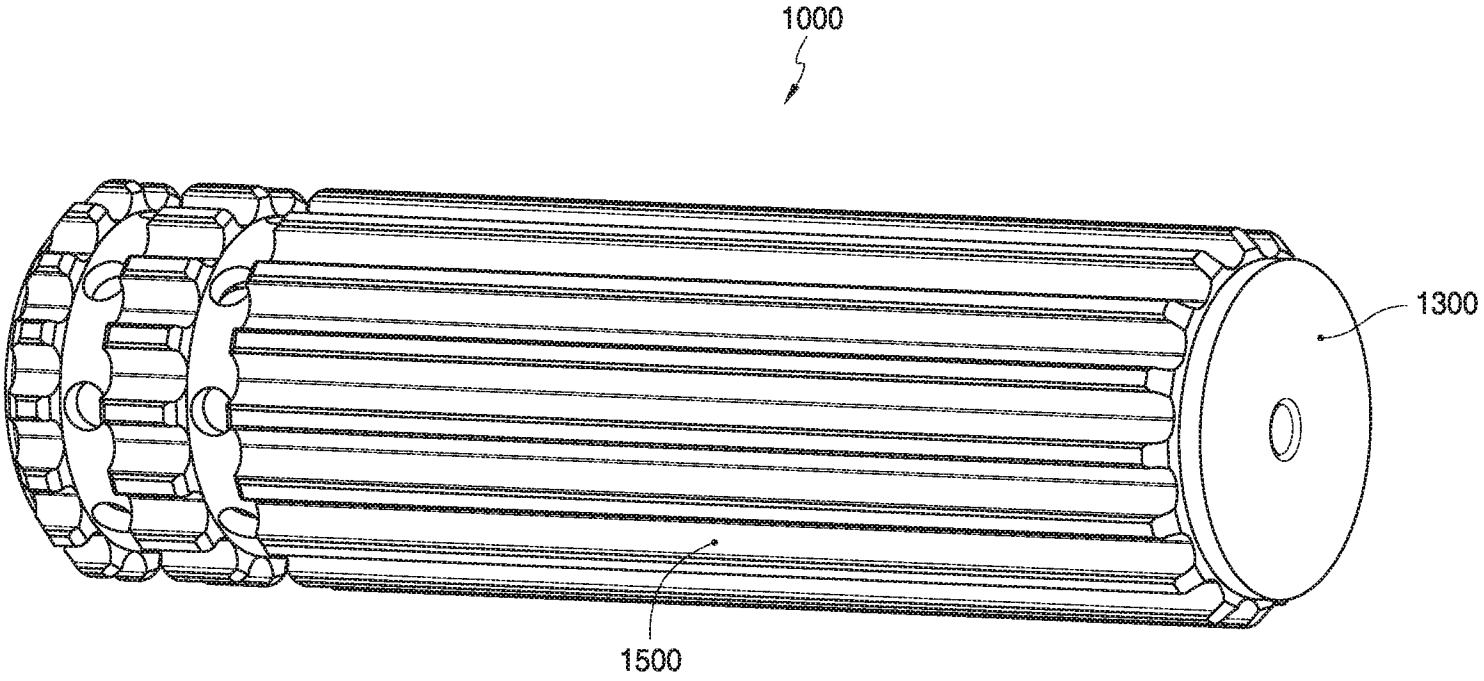

In certain embodiments, a suppressor 1000 (Shown in FIG. 8A-FIG. 8B) comprises a plurality of components assembled as a whole, or manufactured as one or more unitary components, wherein a unitary component comprises a plurality of components discussed herein.

In certain embodiments, as shown in FIG. 8, a suppressor 1000 comprises a first component 1100 configured for outward gas dispersal while maintaining the forward momentum of gasses received from a firearm at a proximal aspect 1010 of the suppressor, a second component 1200 disposed around the first component 1100, wherein the second component 1200 directs gasses toward a distal aspect 1020 of the suppressor. Located at distal aspect 1020 of the suppressor, an endcap 1300 receives the gasses from the second component 1200. Certain embodiments further comprise a sleeve 1400 disposed around the second component 1200 and an outer housing 1500 disposed around the sleeve 1400. Thus, gasses flowing between the second component 1200 and the sleeve 1400 flowing toward the distal aspect 1020 of the suppressor are isolated from the gasses flowing toward the proximal aspect 1010 of the suppressor. In certain embodiments, the suppressor 1000 is affixed to the distal end, or barrel end, of a firearm with a firearm engagement component 1600.

Figure 9A:
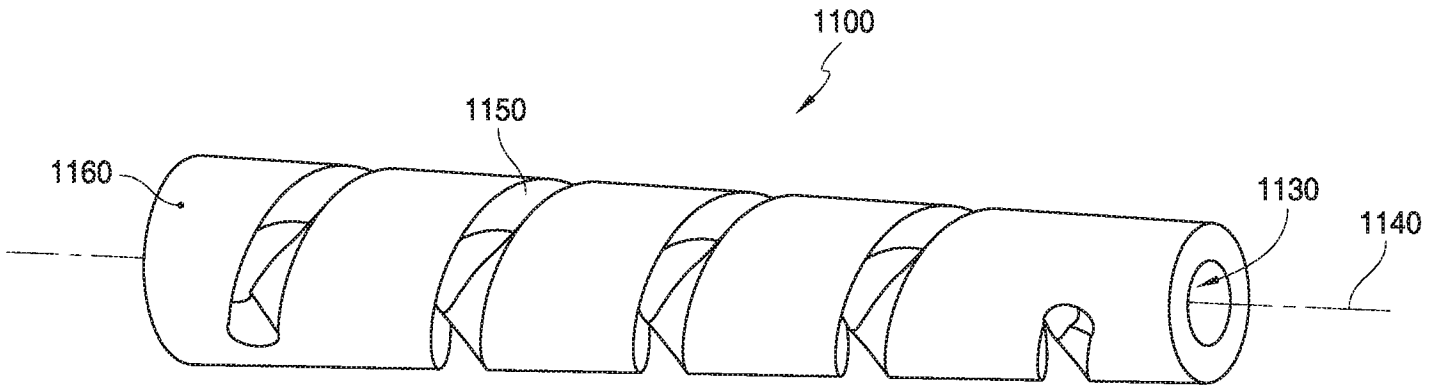
Figure 9B:
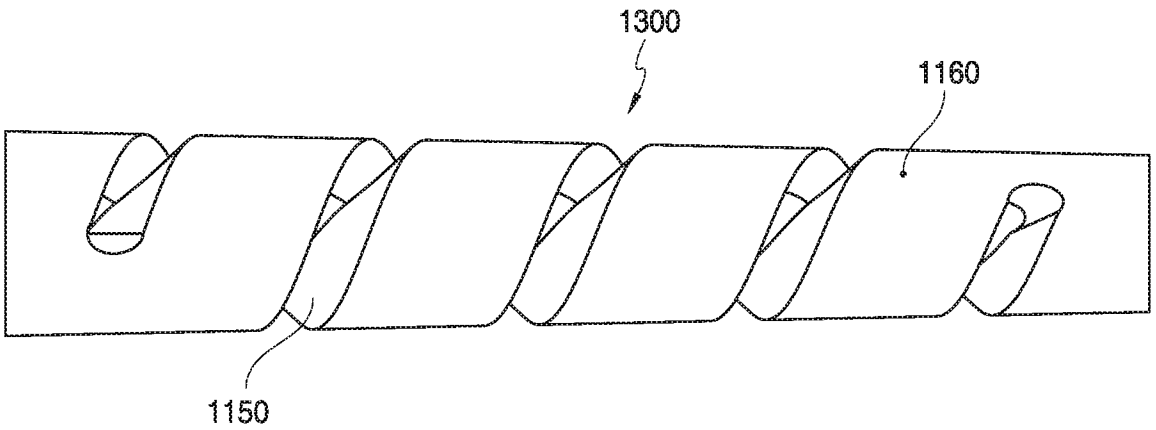

In certain embodiments, shown in FIG. 9A-FIG. 9B, a suppressor comprises a first component 1100 having a cylindrical form with a pathway 1130 coincident with a longitudinal axis 1140. The pathway 1130 is configured to permit the travel of a projectile therethrough. As a projectile exits the firearm it travels through the pathway 1130 of the first component. The first component 1100 of certain embodiments further comprises a helical opening 1150 extending radially between the pathway 1140 and an external aspect 1160 of the first component. It will be appreciated that a helix or helical form comprises a helical axis which is a line that is simultaneously the axis of rotation and the line along which translation of the helix occurs. In certain embodiments, the helical opening 1150 comprises a helical axis which is consistent with the longitudinal axis 1140 of the cylindrical form. It will be further appreciated that an opening resembling a helical form, but not helical form by definition per se, is within the spirit and scope of the present invention. Furthermore, in certain embodiments, a first component 1100 comprises a tapered cylindrical form, conical form, or a form resembling a frustum while in keeping with the spirit and scope of the present invention.

Figure 10A:
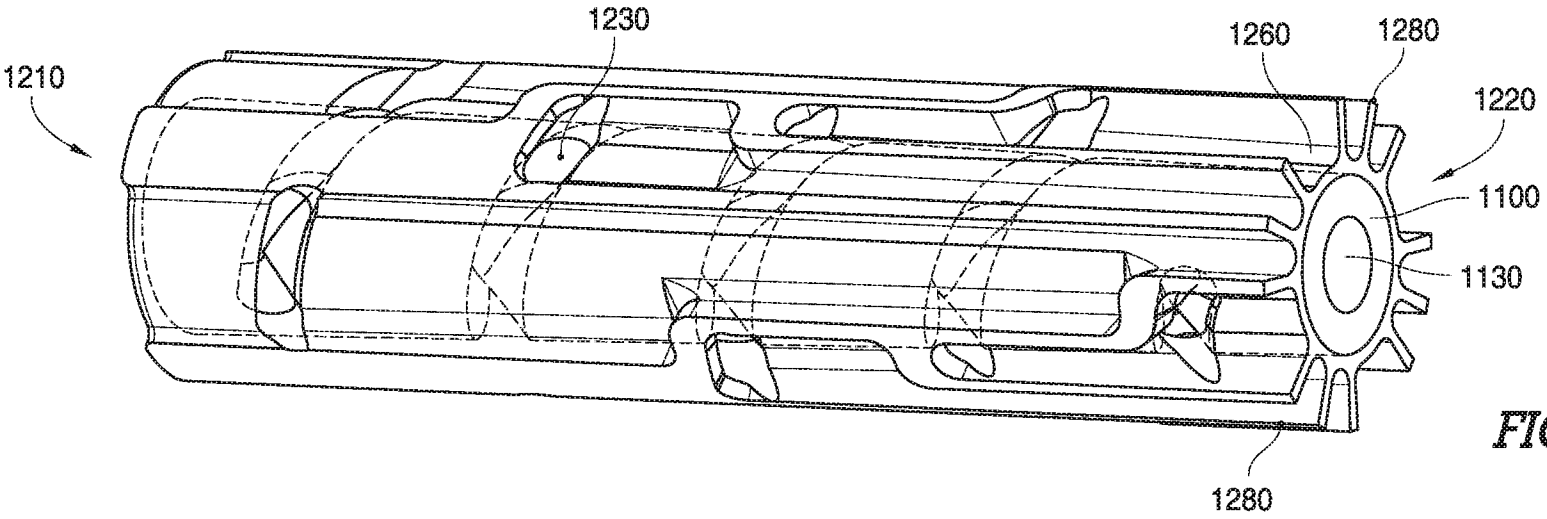
Figure 10B:
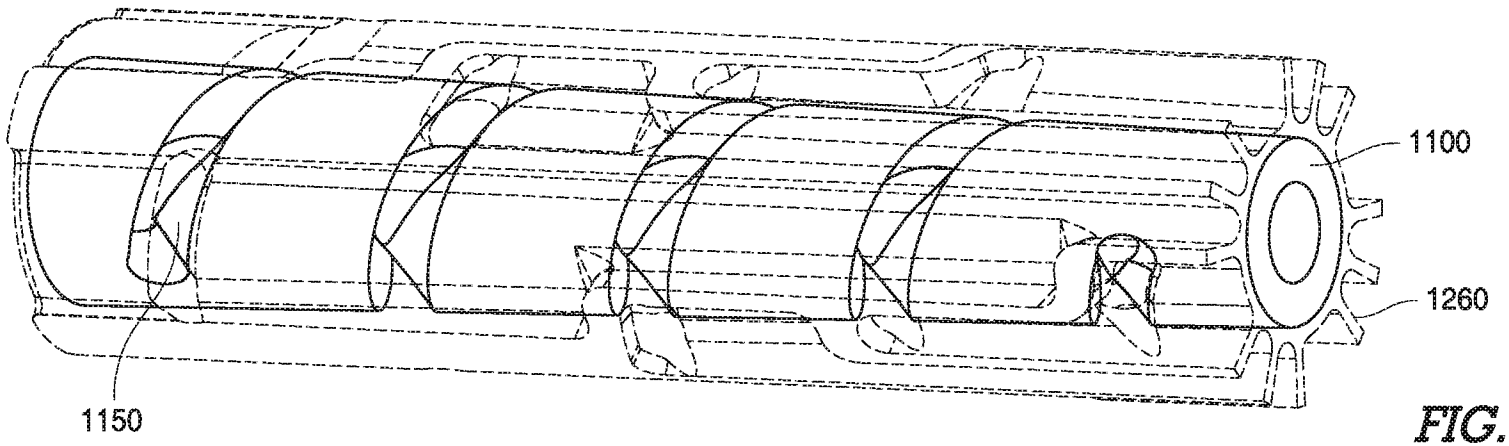
Figure 10C:
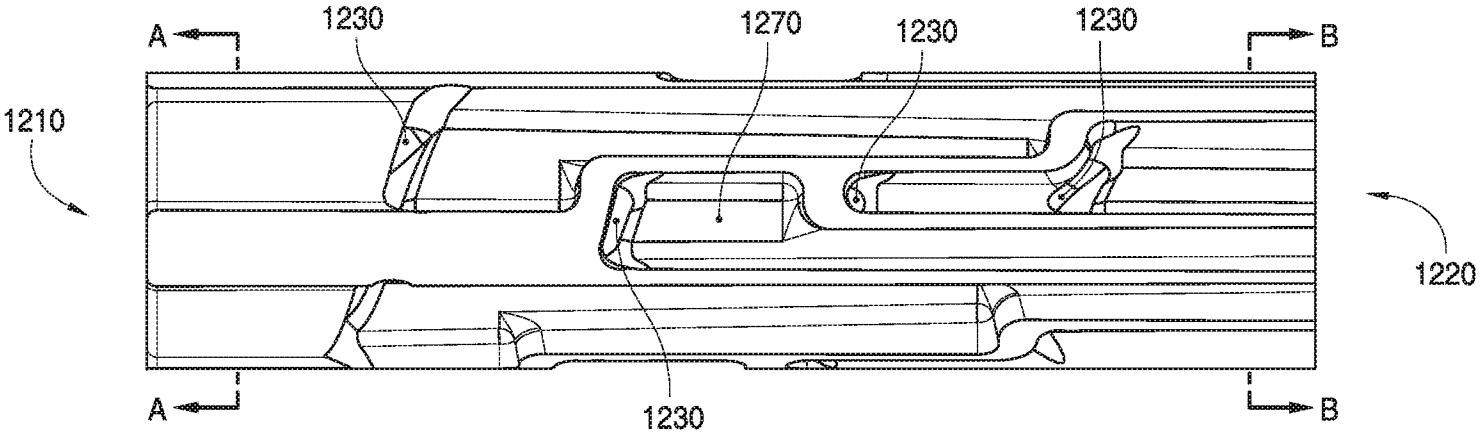

In certain embodiments, seen in FIG. 10A-FIG. 10F, a suppressor comprises a second component 1200 configured to be longitudinally disposed around the first component 1100. The second component aperture 1230 comprises at least one aperture aligned with the helical opening 1150 of the first component. In certain embodiments the second component 1200 further comprises a plurality of apertures 1230 aligned with the helical opening 1150 of the first component wherein gasses pass from the pathway 1130 of the first component to the helical opening 1150, would then pass through the apertures 1230 of the second component. The apertures 1230 of the second component extend from an internal aspect 1240 of the second component to an external aspect 1250 of the second component. In certain embodiments the apertures 1230 of the second component are symmetrical in size and shape, while in alternate embodiments the apertures of the second component vary in size and shape as shown in FIG. 10C. It will be appreciated that the size and shape of the apertures may vary based on specific application, weapon, caliber, powder load—a variation of size and shape of apertures of the second component are in keeping with the spirit and scope of the present invention.

The second component 1200 of certain embodiments further comprises a channel 1260 in the external aspect 1250 of the second component extending from the aperture 1230 toward a longitudinal end of the second component. In certain embodiments, the channel 1260 of a second component extends alternatively toward a distal aspect 1220, or a proximal aspect 1210 of the second component. In alternative embodiments, a distal channel 1260B extends from the aperture 1230 toward the distal end 1220 of the second component, and a proximal channel 1260A extends from the aperture 1230 toward the proximal aspect 1210 of the second component.

Figure 10D:
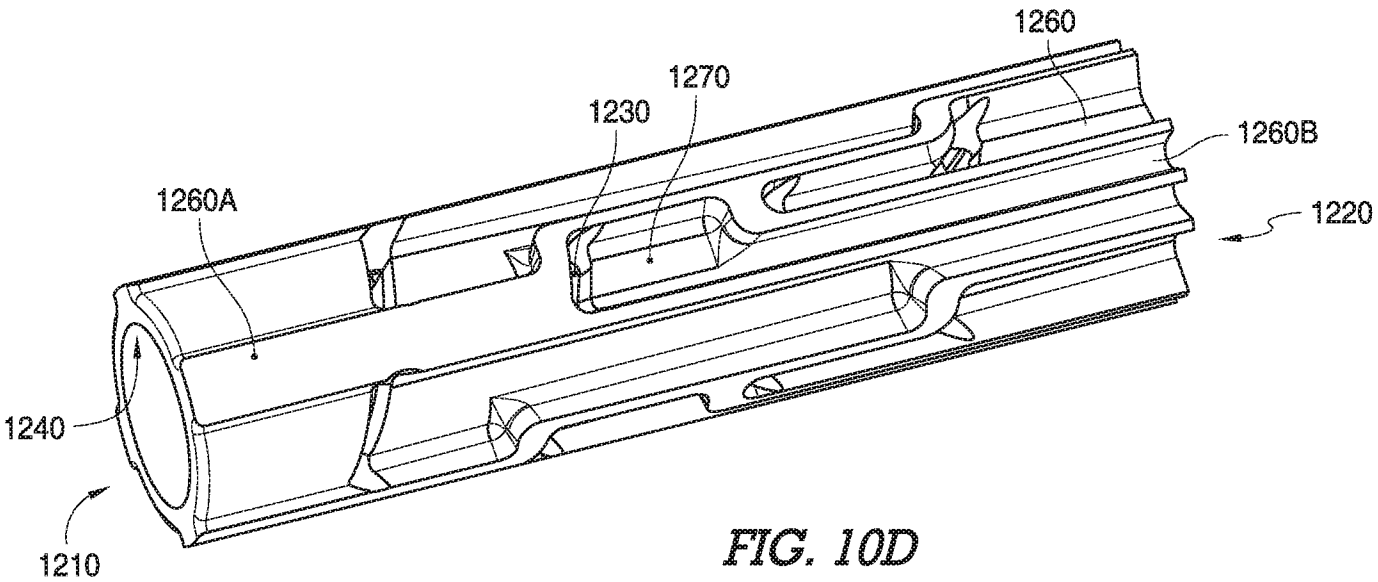
Figure 10F:
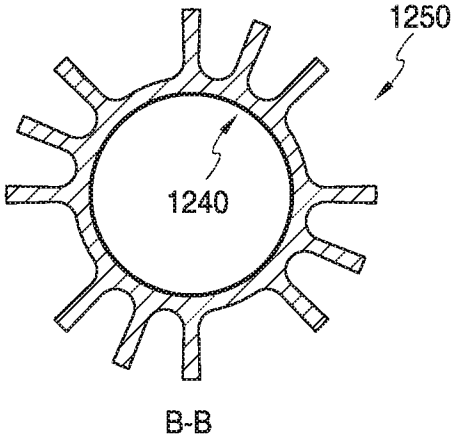
Figure 10E:
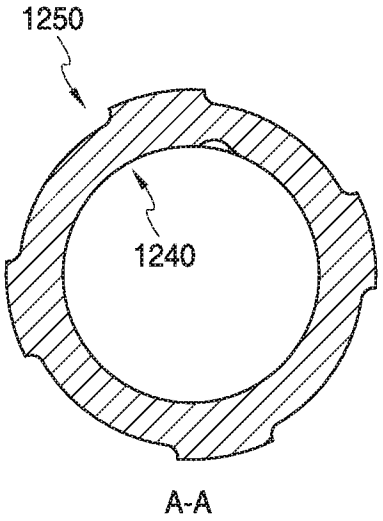

In certain embodiments, referencing FIG. 10C-FIG. 10D, a channel 1260 of a second component aligns with more than one aperture 1230 of the second component. In certain embodiments a channel 1260 further comprises a plenum chamber 1270 wherein gasses received through an aperture 1230 of the second component are contained at a positive pressure, relative to ambient pressure, for further distribution through the channel 1260 toward the distal aspect 1220 of the second component. The channel 1260 of certain embodiments, referencing FIG. 10A and FIG. 10F, further comprises sidewalls 1280 extending radially away from the external aspect 1250 of the second component.

Figure 11:
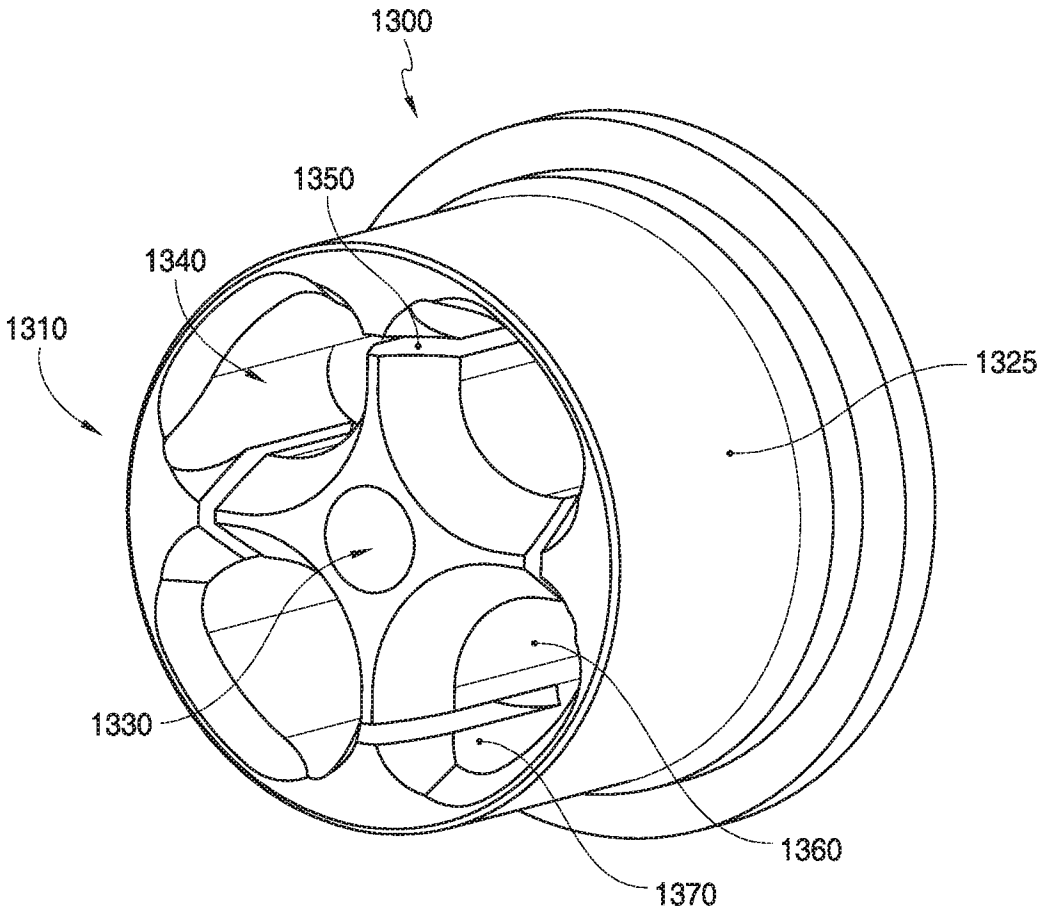
Figure 12A:
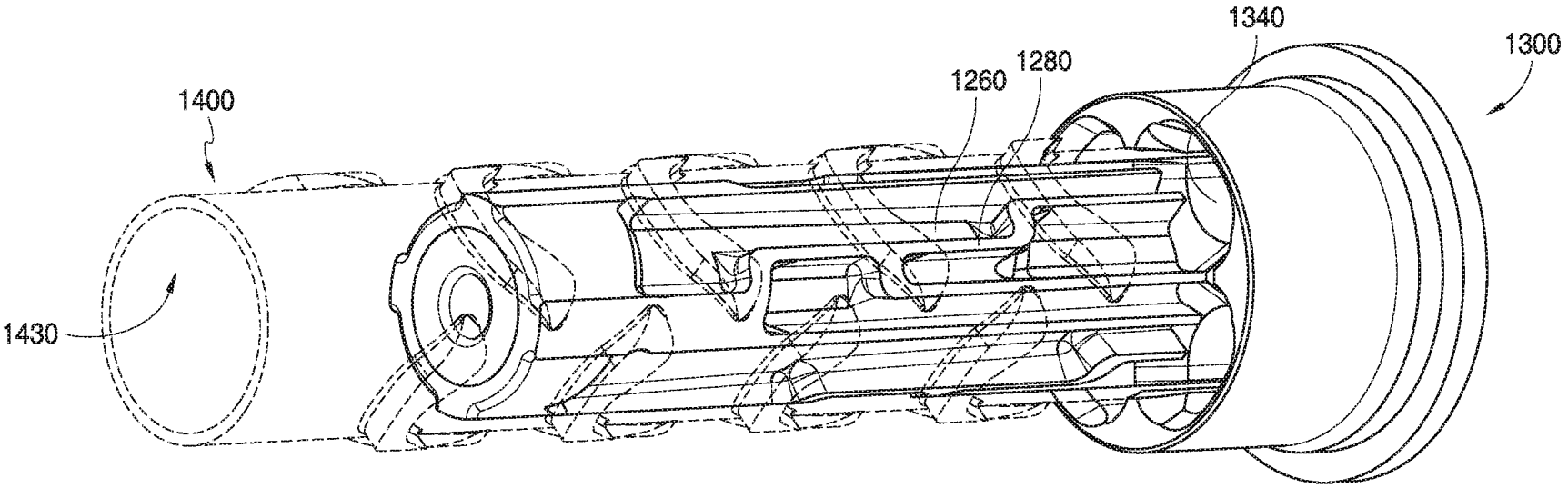
Figure 12B:
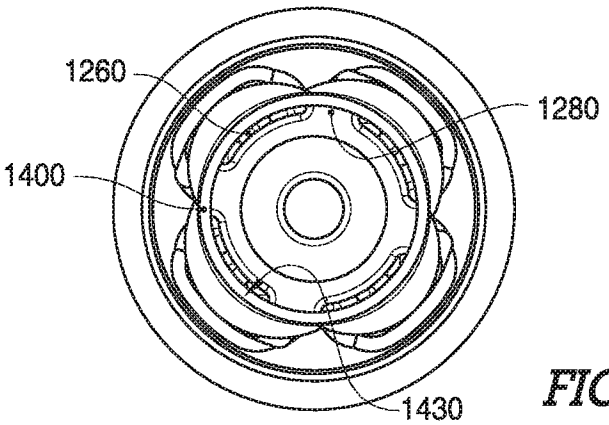

Certain embodiments comprising a suppressor, shown in FIG. 11-FIG. 12B, further comprise an endcap 1300 disposed at a longitudinal end, such as the distal aspect 1220 of the second component, of a second component 1220 (FIG. 10A). The endcap 1300 comprises an aperture 1330 configured to align with the pathway 1130 (FIG. 9A) of the first component, wherein a projectile exits the firearm, travels through the pathway 1130 of the first component, and travels through the aperture 1330 of the endcap and exits the suppressor. The endcap 1300 further comprises a recess 1340 in the proximal aspect 1310 of the endcap wherein the recess 1340 is configured to align with one or more channels 1260 (FIG. 10A-FIG. 10F) of the second component. The recess is configured to receive gasses which travel toward the endcap 1300 through a channel. An endcap 1300 of certain embodiments comprises a plurality of recesses 1340 in the proximal aspect 1310 of the endcap, radially distributed around the aperture 1320.

Certain embodiments comprise a suppressor having a sleeve 1400, shown in FIG. 12A-FIG. 12E, disposed over a second component 1200 wherein an internal aspect 1430 of the sleeve interfaces with the sidewalls 1280 of the channels thereby resulting in a seal between the sleeve 1400 and the sidewalls 1280. Thus, in certain embodiments comprising a plurality of channels 1260 (FIG. 10D), the channels 1260 are individually sealed in relation to adjacent channels 1260 which prevents gasses from intermixing laterally between channels 1260. Thus, the gasses proceed down the channel 1260, and into a recess 1340 of an endcap prior to mixing with gasses of adjacent channels 1260.

Figure 12C:
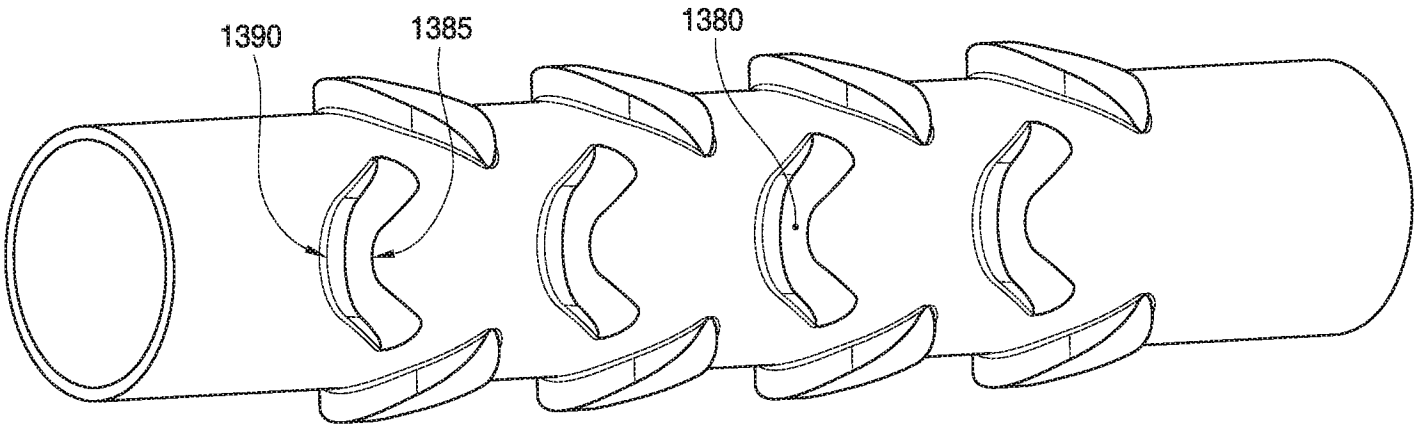
Figure 12D:
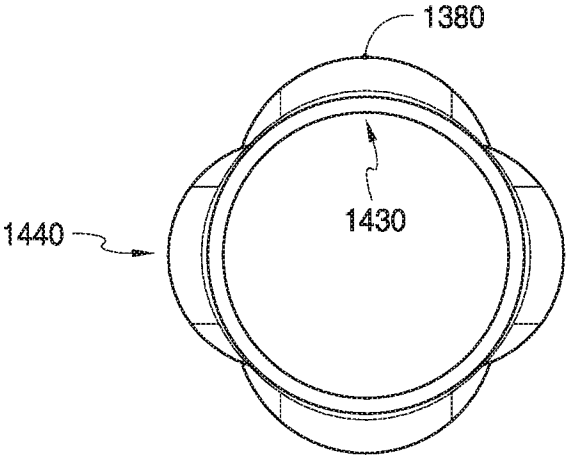
Figure 12E:
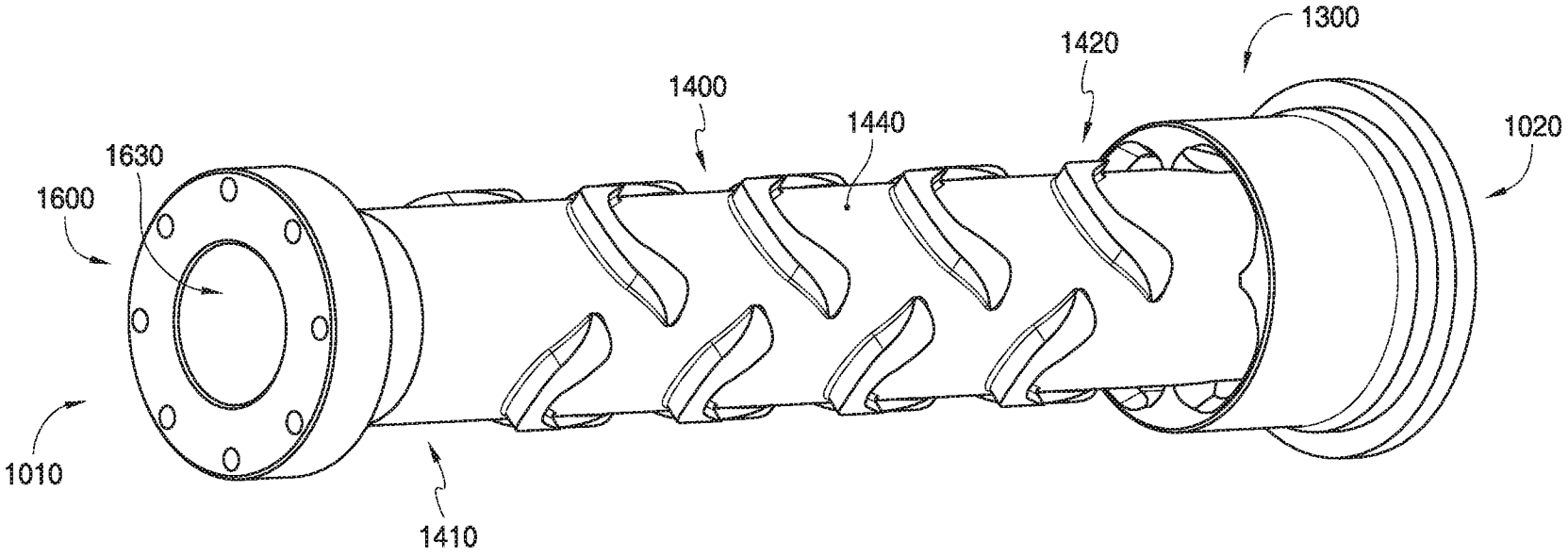

The sleeve 1400 of certain embodiments, referencing FIG. 11-FIG. 12E, comprises a cylindrical form which is configured to abut the proximal aspect 1310 of the endcap, thereby bifurcating the recess 1340 into an internal aspect 1360 and an external aspect 1370. The gasses which exit a channel 1260 enter the recess 1340 through the internal aspect 1360, and proceed into the external aspect 1370 of the recess. In certain embodiments, shown in FIG. 11-FIG. 12E, an endcap 1300 comprises a slot 1350 configured to receive an end, such as the distal aspect 1420 of a sleeve. In certain embodiments, as shown, the slot 1350 comprises an annular shape in order to receive the cylindrical form of the sleeve 1400.

Figure 13:
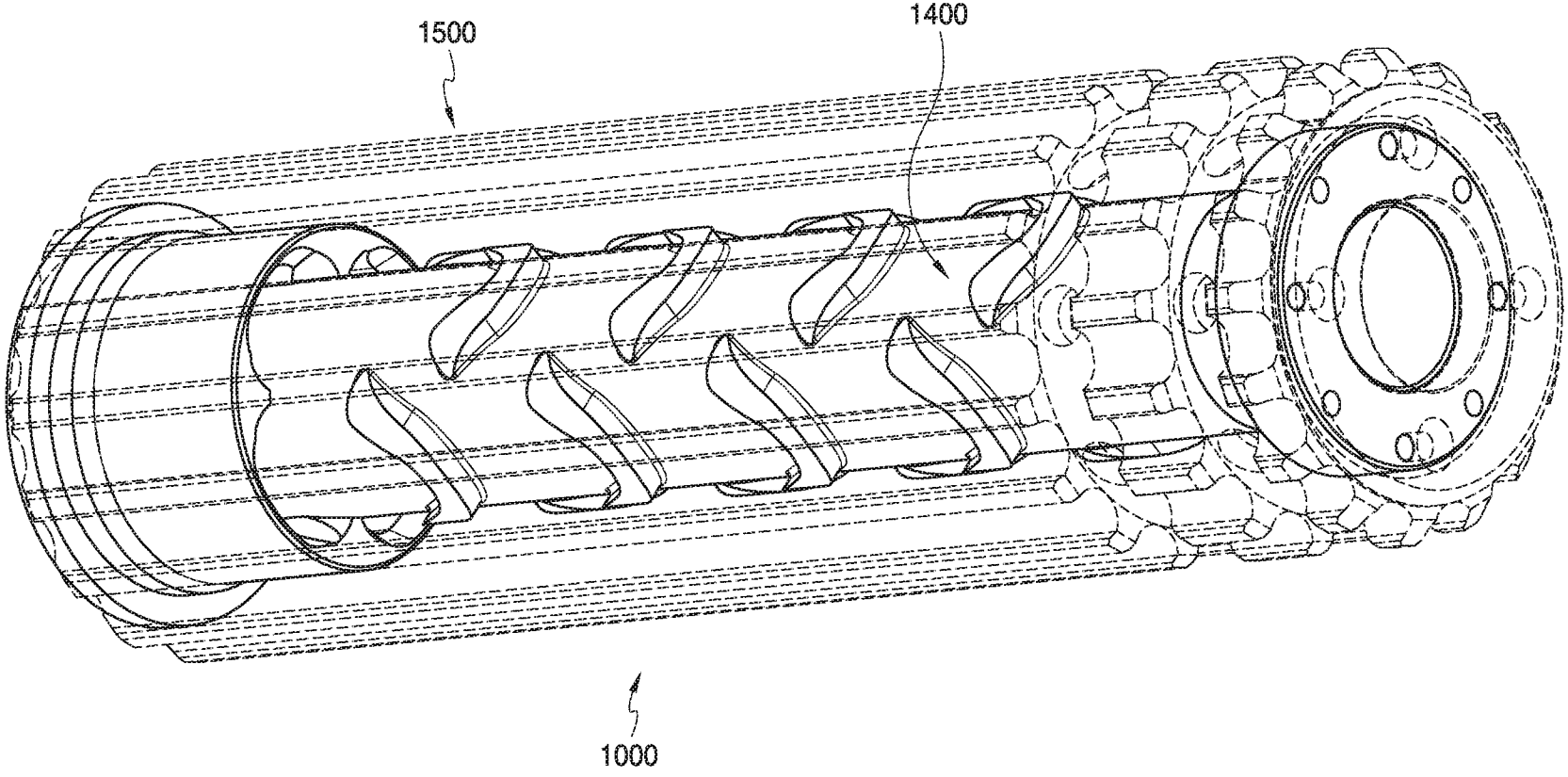
FIG. 13—A perspective view of certain embodiments of a suppressor wherein an outer housing is shown as transparent FIG. 14—A cross-sectional view of certain embodiments of an assembled suppressor FIG. 15A—A perspective view of certain embodiments of an outer housing FIG. 15B—An end view of certain embodiments of an outer housing
Figure 14:
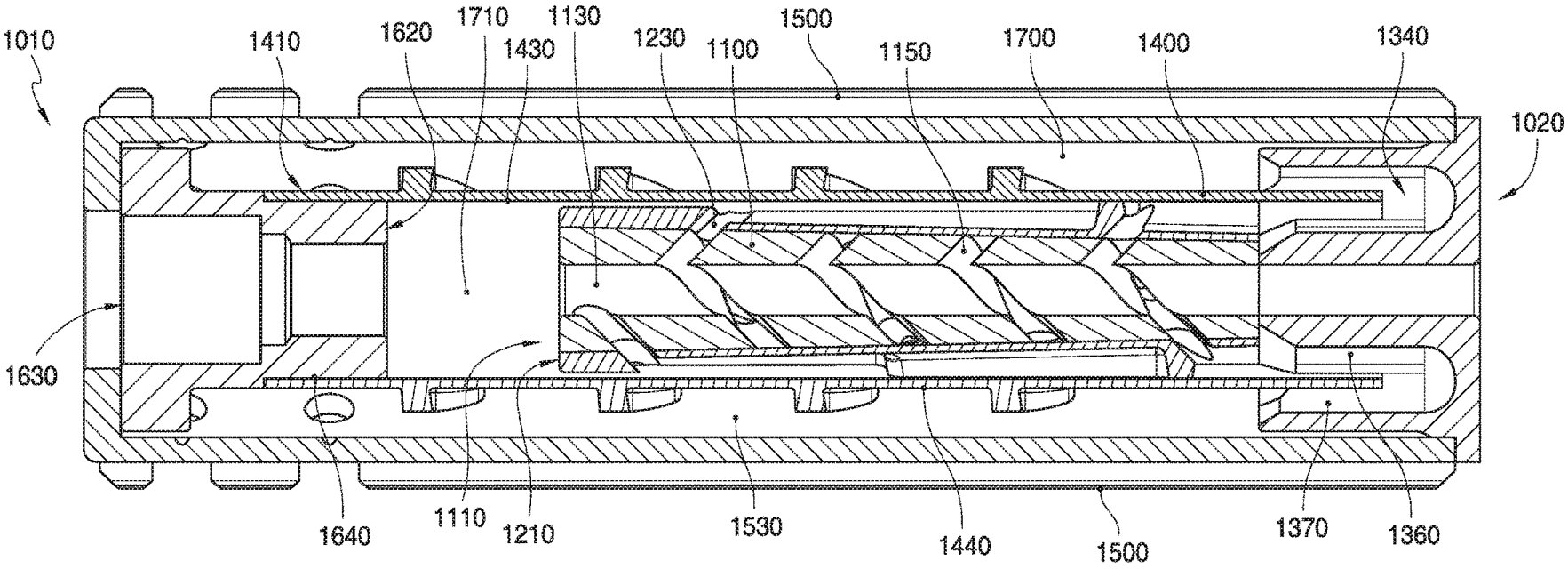

Certain embodiments, seen in FIG. 13-FIG. 14, comprise an outer housing 1500 disposed longitudinally around the sleeve 1400 wherein an internal aspect 1530 of the outer housing is offset from an external aspect 1440 of the sleeve resulting in a volume 1700 bordered by the sleeve 1400 and the outer housing 1500. The volume 1700 between the sleeve 1400 and the outer housing 1500 is in gaseous communication with at least one recess 1340 of the endcap. The external aspect 1370 of the recess is in gaseous communication with the volume between the sleeve and the outer housing, while the internal aspect 1360 of the recess is in gaseous communication with the channels 1260 of the second component.

In certain embodiments the external aspect of the sleeve comprises flow restrictors 1380, seen in FIG. 12C-FIG. 12D, configured to encourage flow from the endcap 1300 toward the opposite longitudinal end of the sleeve 1400. In certain embodiments wherein the endcap 1300 is disposed at the distal aspect 1020 of the suppressor, the flow restrictors 1380 serve to reduce gas flow velocities as the gasses proceed from a distal aspect of the sleeve 1420 toward a proximal aspect 1410 of the sleeve. The flow restrictors 1380 of certain embodiments comprise a protuberance extending radially from an external aspect 1440 of the sleeve. A leading aspect 1385 of the protuberance comprises a radial form presenting a leading aspect 1385 having a concave form toward an upstream direction. It will be appreciated to those skilled in the art that an upstream direction in the present context of the instant invention surrounds the direction from which gasses flow. Accordingly, a downstream direction in the present context of the instant invention surrounds the direction toward which gasses flow. In certain embodiments the protuberances comprise a radial form presenting a trailing aspect 1390 having a convex form toward a downstream direction. In certain embodiments flow restrictors extending radially away from an external aspect of a sleeve comprise a protuberance having a tapered form wherein a leading aspect 1385 of the protuberance comprises a height less than a height of a trailing aspect 1390 of the protuberance.

Certain embodiments comprising an endcap 1300 at the distal end 1020 of the suppressor, further comprise a firearm engagement component 1600 (FIG. 12E and FIG. 14) disposed at a proximal aspect 1010 of a suppressor. The firearm engagement component 1600 comprises an aperture 1630 configured to align with the pathway 1130 of the first component. In certain embodiments a distal aspect 1620 of the firearm engagement component is axially offset from the first component 1100, thereby creating an intermediate volume 1710 between the distal aspect 1620 of the firearm engagement component and the proximal aspect 1110 of the first component. It will be appreciated to those skilled in the art that the intermediate volume 1710 of certain embodiments provides the function of a plenum chamber, wherein gasses received through the aperture 1630 of the firearm engagement component are contained at a positive pressure prior to passing through the pathway 1130 of the first component.

In certain embodiments, a proximal aspect 1410 of a sleeve is disposed over an external aspect 1620 of the firearm engagement component, wherein an internal aspect 1430 of the sleeve mates with the external aspect 1640 of the firearm engagement component to create a seal. In certain embodiments, the second component 1200 comprises a proximal channel 1260A extends toward the proximal aspect 1210 of the second component and is in gaseous communication with the intermediate volume 1710, and a distal channel 1260B extends from the proximal channel 1260A toward the distal aspect 1020 of the suppressor. In such embodiments, a portion of the gasses from the intermediate volume 1710 proceed through the pathway 1130 of the first component, through the helical opening 1150, through an aperture 1230 of the second component, and into the distal channel 1260B, while a portion of gasses from the intermediate volume 1710 proceed through the proximal channel 1260A, and into the distal channel 1260B (See FIG. 10D)

Certain embodiments comprise an outer housing 1500 disposed around an external aspect 1325 of the end cap as seen in FIG. 11, FIG. 14A-FIG. 14B, and FIG. 15A-FIG. 15B. The outer housing 1500 creates a seal between an internal aspect 1530 of the outer housing and the external aspect 1325 of the endcap.

Figure 15A:
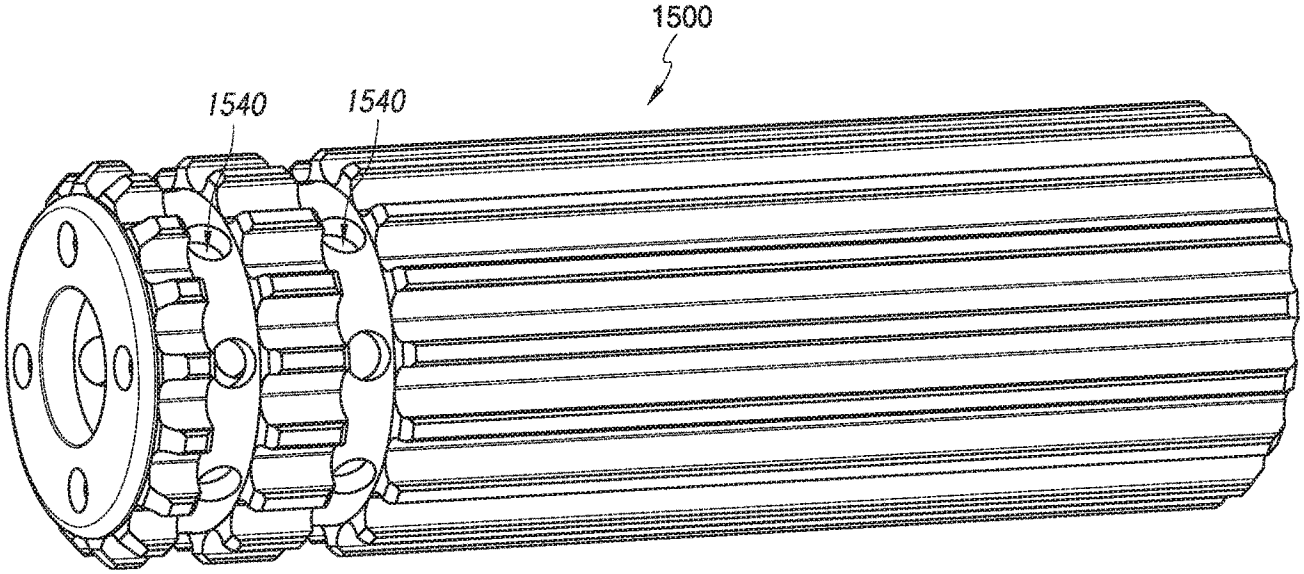
Figure 15B:
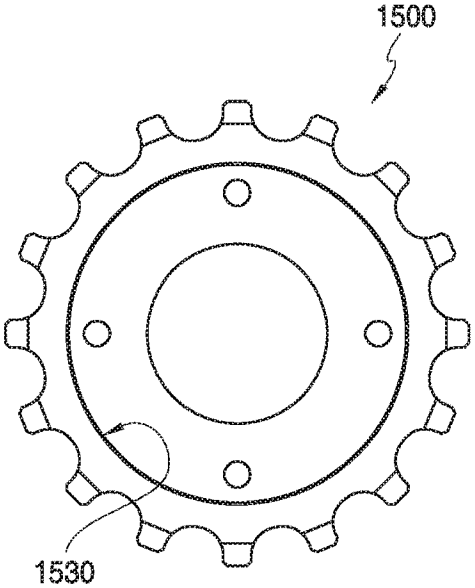

In certain embodiments, shown in FIG. 14-FIG. 15A, gasses enter into a suppressor of the present invention from a proximal aspect 1010, travel through a pathway 1130 toward a distal aspect of the suppressor 1020. The gasses then proceed to a volume 1700 disposed radially outward from the pathway 1030 toward a proximal aspect 1010 of the suppressor. The gasses upon approach of the proximal 1010 aspect of the suppressor—are permitted to expand radially outward through apertures 1540, thus exiting the suppressor 1000 to the surrounding environment. In certain embodiments the volume 1700 comprises an annular volume surrounding the pathway 1030 wherein the gasses transfer from the pathway 1030 to the volume 1700 at the distal aspect 1020 of the suppressor.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. The terms "first," "second," "proximal," "distal," etc., as used herein, are intended for illustrative purposes only and do not limit the embodiments in any way. Additionally, the term "plurality," as used herein, indicates any number greater than one, either disjunctively or conjunctively, as necessary, up to an infinite number. The benefits, advantages, solutions to problems, and any element(s) that may cause any benefit, advantage, or solution to occur or become more pronounced are not to be construed as a critical, required, or essential features or elements of any or all the claims.

What is claimed:

1. A firearm suppression device comprising:

a first component having a pathway along an axis, the pathway extending from a proximal end of the first component to a distal end of the first component, wherein the pathway is configured to permit the passage of a projectile therethrough;

the first component further comprising a helical opening extending radially between the pathway and an external surface of the first component, and the helical opening having a helical axis consistent with the axis of the first component;

a second component disposed longitudinally around the first component, the second component having an aperture aligned with the helical opening;

the second component further comprising a channel in the external aspect of the second component, the channel in the second component extending from the aperture to a distal aspect of the second component; and the aperture extending radially from an internal aspect of the second component to an external aspect of the second component.

2. The device of claim 1, wherein the channel further comprises sidewalls extending radially away from the external aspect of the second component.

3. The device of claim 2, further comprising an endcap at a distal end of the first component, the endcap having an aperture configured to align with the pathway of the first component;

and a recess aligned with the channel of the second component.

4. The device of claim 3, wherein a sleeve is disposed longitudinally around the second component, and wherein an internal aspect of the sleeve is in contact with the sidewalls of the channel.

5. The device of claim 4, wherein an external aspect of the sleeve having flow restrictors affixed to an external aspect of the sleeve, wherein the flow restrictors expanding circumferentially in a proximal direction.

6. The device of claim 5, further comprising an outer housing disposed longitudinally around the second component; and the outer housing comprising an internal aspect offset radially from the external aspect of the sleeve.

7. The device of claim 6, wherein the outer housing further comprises apertures extending radially from the internal aspect of the outer housing to an external aspect of the outer housing.

8. The device of claim 2, wherein a sleeve is disposed longitudinally around the second component, and wherein an internal aspect of the sleeve is in contact with the sidewalls of the channel.

9. A suppressor device comprising a proximal aspect and a distal aspect;

the proximal aspect configured to affix to the muzzle-end of a firearm;

a pathway extending from the proximal aspect to the distal aspect of the suppressor, wherein the pathway is configured to allow the passage of a projectile therethrough;

a volume offset radially outward from the pathway; and an intermediate volume upstream from the pathway having a diameter greater than a diameter of the pathway, wherein gasses from the firearm enter the proximal aspect of the suppressor, travel through the pathway, travel toward the distal aspect of the suppressor, enter the volume, and travel toward the proximal aspect of the suppressor, wherein the gasses enter the intermediate volume prior to entering the pathway, wherein the suppressor further comprises apertures located at a proximal aspect of the suppressor, wherein the gasses exit the suppressor through the apertures, wherein the apertures are configured to direct gasses radially outward.

* * * * *